US010381710B1

(12) United States Patent
Kuo et al.

(10) Patent No.: US 10,381,710 B1
(45) Date of Patent: Aug. 13, 2019

(54) SINGLE FEED PASSIVE ANTENNA FOR A METAL BACK COVER

(71) Applicant: AMAZON TECHNOLOGIES, INC., Seattle, WA (US)

(72) Inventors: Jerry Weiming Kuo, San Jose, CA (US); Mudit Sunilkumar Khasgiwala, Milpitas, CA (US); Adrian Napoles, Cupertino, CA (US); Ming Zheng, Cupertino, CA (US)

(73) Assignee: Amazon Technologies, Inc., Seattle, WA (US)

( * ) Notice: Subject to any disclaimer, the term of this patent is extended or adjusted under 35 U.S.C. 154(b) by 393 days.

(21) Appl. No.: 15/082,883

(22) Filed: Mar. 28, 2016

Related U.S. Application Data

(63) Continuation-in-part of application No. 14/967,988, filed on Dec. 14, 2015.

(51) Int. Cl.

| | |
|---|---|
| ***H01Q 1/24*** | (2006.01) |
| ***H01Q 1/22*** | (2006.01) |
| ***H01Q 5/30*** | (2015.01) |
| ***H01Q 9/04*** | (2006.01) |

(52) U.S. Cl.
CPC ..... *H01Q 1/2266* (2013.01); *H01Q 1/243* (2013.01); *H01Q 5/30* (2015.01); *H01Q 9/0407* (2013.01)

(58) Field of Classification Search
CPC ..... H01Q 1/2266; H01Q 5/314; H01Q 5/321; H01Q 5/328; H01Q 5/335
See application file for complete search history.

(56) References Cited

U.S. PATENT DOCUMENTS

| | | | | |
|---|---|---|---|---|
| 9,509,042 | B1 | 11/2016 | Zheng et al. | |
| 2011/0001673 | A1 | 1/2011 | You et al. | |
| 2012/0112969 | A1* | 5/2012 | Caballero | H01Q 1/243 343/702 |
| 2012/0299785 | A1 | 11/2012 | Bevelacqua | |
| 2013/0169490 | A1 | 7/2013 | Pascolini et al. | |
| 2014/0266922 | A1 | 9/2014 | Jin et al. | |
| 2014/0329558 | A1 | 11/2014 | Darnell et al. | |
| 2015/0171916 | A1 | 6/2015 | Asrani et al. | |

(Continued)

FOREIGN PATENT DOCUMENTS

| | | | |
|---|---|---|---|
| CN | 102394354 | A | 3/2012 |
| WO | 2013107921 | A1 | 7/2013 |

*Primary Examiner* — Daniel Munoz
(74) *Attorney, Agent, or Firm* — Lowenstein Sandler LLP

(57) ABSTRACT

Antenna structures and methods of operating the same are described. One apparatus includes a radio frequency (RF) circuitry, a housing, an antenna structure, and multi-connector switching circuitry. The RF circuitry includes a first RF feed for a first frequency and a second RF feed for a second frequency. The housing includes a first strip element disposed at a periphery of the housing, where the first strip element is physically separated from the housing by a first cutout in the housing. The antenna structure includes the first strip element with a first connector, a second connector, and a third connector coupled to the multi-connector switching circuitry. The multi-connector switching circuitry connects the first RF feed coupled to the first RF feed and the second RF feed where the first switching circuit to connect the first strip element to the first RF feed in a first mode of the first multi-connector switching circuitry.

20 Claims, 18 Drawing Sheets

(56) References Cited

U.S. PATENT DOCUMENTS

| | | | | |
|---|---|---|---|---|
| 2015/0200463 | A1* | 7/2015 | Heikura | H01Q 1/245<br>455/73 |
| 2016/0351997 | A1* | 12/2016 | Wu | H01Q 1/243 |

* cited by examiner

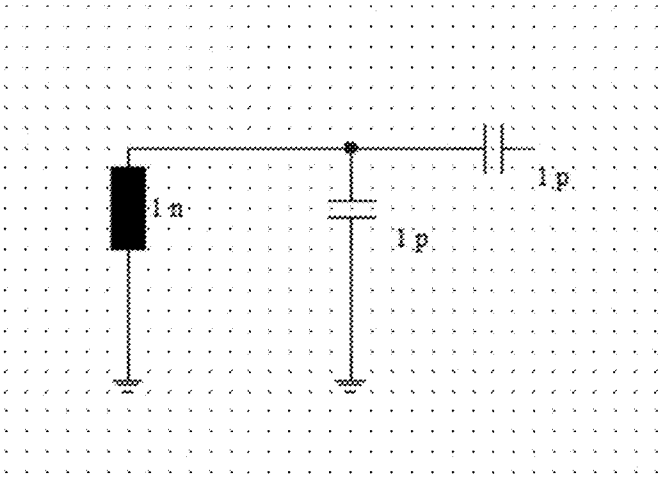
FIG. 3B
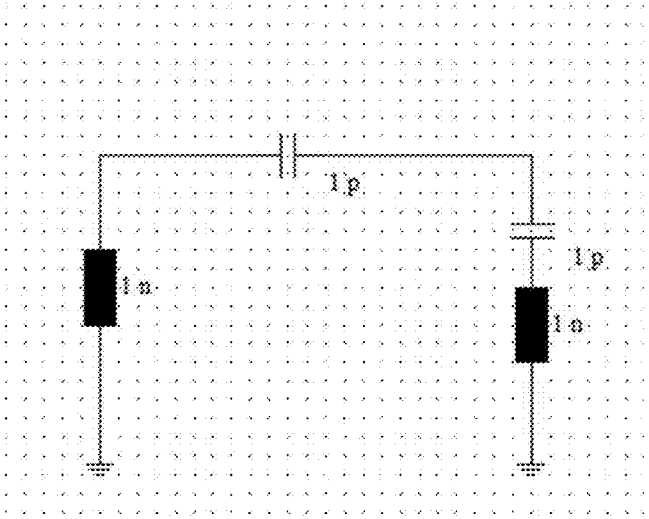
FIG. 3C
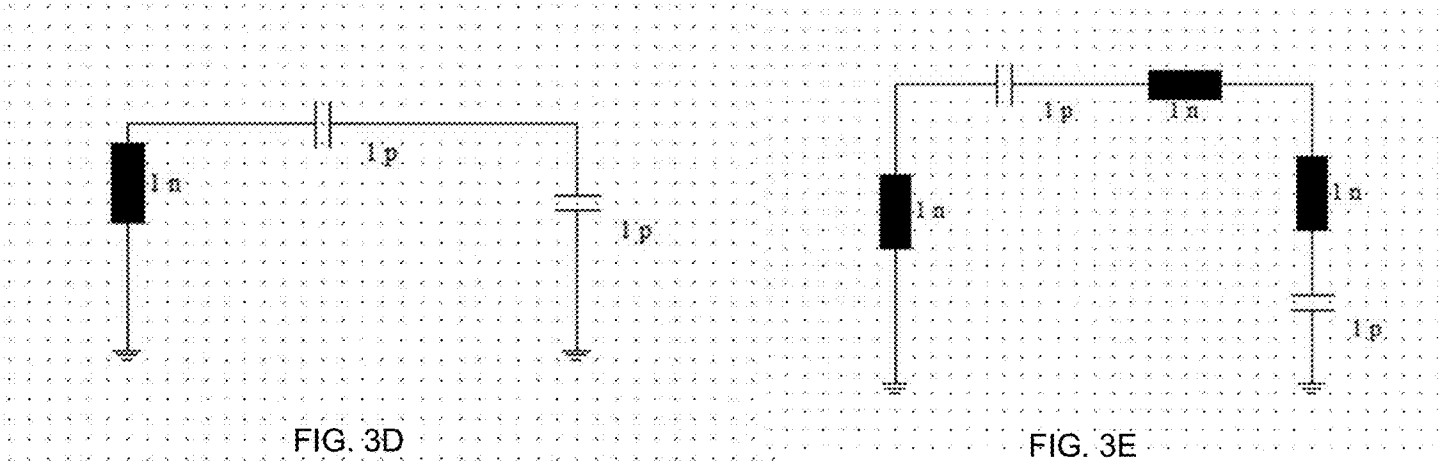
FIG. 3D
FIG. 3E

SINGLE FEED PASSIVE ANTENNA FOR A METAL BACK COVER

RELATED APPLICATIONS

This application is a continuation in part of application of U.S. patent application Ser. No. 14/967,988, filed on Dec. 14, 2015, the entire contents of which are hereby incorporated by reference. This application is related to U.S. patent application Ser. No. 14/819,412, filed Aug. 5, 2015.

BACKGROUND

A large and growing population of users is enjoying entertainment through the consumption of digital media items, such as music, movies, images, electronic books, and so on. The users employ various electronic devices to consume such media items. Among these electronic devices are electronic book readers, cellular telephones, personal digital assistants (PDAs), portable media players, tablet computers, netbooks, laptops and the like. These electronic devices wirelessly communicate with a communications infrastructure to enable the consumption of the digital media items. In order to wirelessly communicate with other devices, these electronic devices include one or more antennas.

BRIEF DESCRIPTION OF DRAWINGS

The present invention will be understood more fully from the detailed description given below and from the accompanying drawings of various embodiments of the present invention, which, however, should not be taken to limit the present invention to the specific embodiments, but are for explanation and understanding only.

FIGS. 3B-3E illustrates example impedance matching circuits that can be used for integration of the proximity sensing circuitry into the antenna structure according to various embodiments.

DETAILED DESCRIPTION

Figure 1A:
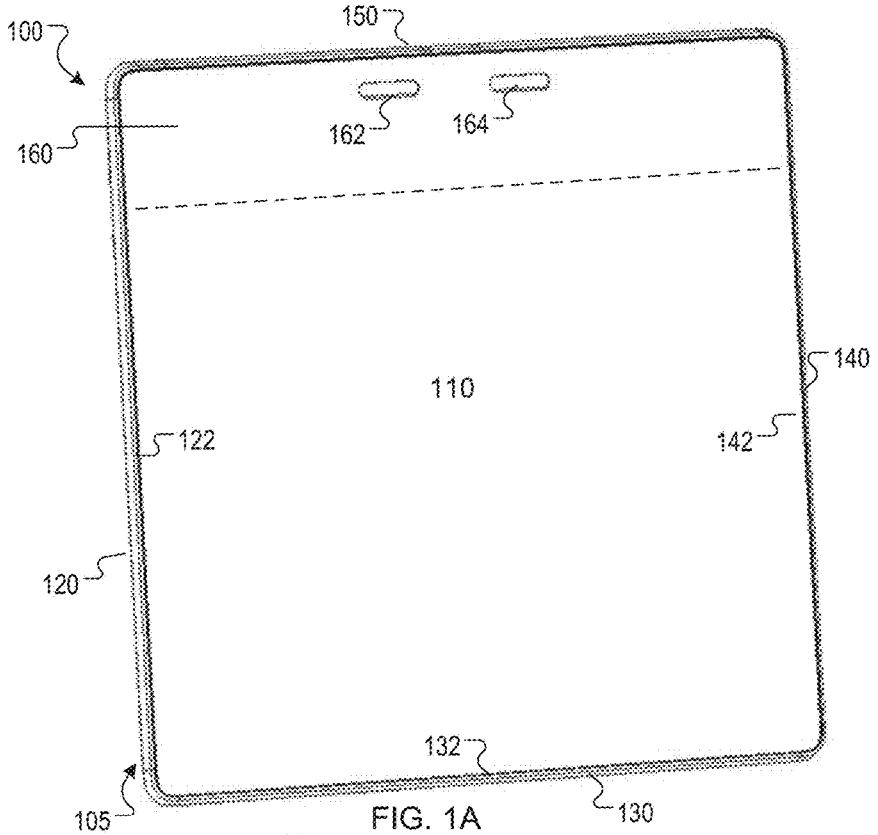
FIG. 1A shows an electronic device with thin borders around a portion of a display structure according to one embodiment.

Electronic devices traditionally use conventional antennas that may be externally mounted to the electronic devices (e.g., external antennas) to avoid interference from internal components and housings of the electronic devices. As electronic devices continue to be miniaturized, antennas may be integrated within the electronic devices to increase functionality and aesthetic design of the electronic devices.

With the integration of antennas into the electronic devices, materials of the housings of the electronic devices may increase a level of interference generated by the housing for the integrated antennas when the electronic devices communicate data. For example, to provide durability and ruggedness, an electronic device can have a metal housing. However, the metal housing may reflect electromagnetic waves communicated between the integrated antenna and antennas of other electronic devices. The reflection of the electromagnetic waves can interfere with the integrated antenna transmitting and receiving signals. One conventional solution for mobile devices that utilize antennas within metal housings is to require windows in the metal at or nearby the corners of the metal housing to reduce interference. Another conventional solution for mobile devices that utilize antennas within metal housings is to use active components (e.g., tunable components). Additionally, the conventional integrated antennas may not have sufficient bandwidth to meet a bandwidth demand for services used by the electronic device. For example, a metal housing can interfere with a bandwidth of an integrated antenna used for wireless communications over a cellular network or other wireless networks, as described herein.

Additionally, an electronic device can include display components mounted to the housing. Size and weight can be important considerations in designing a display for the electronic device. For example, an electronic device with a bulky display or a display surrounded by large borders may be undesirable. The housing of the electronic device can be adjusted to accommodate a bulky display and large borders, but the adjustment may lead to an enlargement of the size and weight of the housing and unappealing device aesthetics.

A display of an electronic device can include various components and layers. The various components and layers can include a display layer to display information and a sensing layer with sensing components (e.g., touch sensors) for a touch screen display. The sensing components can include touch traces or indium tin oxide (ITO) traces that are transparent conductors between layers of glass of the display that form a matrix of conductors for a touch screen to receive inputs from a user. Conventionally, the touch traces or the ITO traces of a display can interfere with a signal of an antenna. For example, the touch traces or the ITO traces of a touchpad can create electrostatic fields used to detect a finger. The electrostatic fields can cause interference with an electromagnetic field of an antenna. In another example, as a size of the display increases and a size of a border around the display decrease, the interference from the touch traces or ITO traces can increase as a physical separation between the touch traces or ITO traces and an antenna decreases.

The embodiments described herein may address the above noted deficiencies by an electronic device employing an antenna structure that utilizes a metal housing of the electronic device. The antenna structure herein can utilize a portion of the metal housing as a low-band radiator and a high-band radiator (e.g., strip elements) without windows nearby the corners as done conventionally. In one example, the electronic device can use the low-band radiator to communicate on a wireless communication network. In another example, the electronic device can use the high-band radiator to communicate on a cellular communication network. The antenna structure can also utilize switching elements and a switching circuit to support multi-band communications, such as communications following wide area network (WAN) communications standards or communications standards for the Wi-Fi® technology.

The electronic device may be any content rendering device that includes a modem for connecting the electronic device to a network. Examples of such an electronic device include an electronic book reader, a portable digital assistant, a mobile phone, a laptop computer, a portable media player, a tablet computer, a camera, a video camera, a netbook, a notebook, a desktop computer, a gaming console, a Blu-ray® or DVD player, a media center, a drone, a speech-based personal data assistant, and the like. The electronic device may connect to a network to obtain content from a server computing system (e.g., an item providing system) or to perform other activities. The electronic device may connect to one or more different types of cellular networks.

Several topologies of antenna structures are contemplated herein. The antenna structures described herein can be used for WAN technologies, such as cellular technologies including Long Term Evolution (LTE®) frequency bands, third generation (3G) frequency bands, Wi-Fi® frequency bands or other wireless local area network (WLAN) frequency bands, Bluetooth® frequency bands or other personal area network (PAN) frequency bands, global navigation satellite system (GNSS) frequency bands (e.g., positioning system (GPS) frequency bands), and so forth. In one example, the LTE® frequency bands can include a B1 band, a B2 band, a B4 band, a B5 band, a B8 band, a B12 band, or a B17 band.

In another example, the cellular network employing a third generation partnership project (3GPP®) release 8, 9, 10, 11, or 12 or Institute of Electronics and Electrical Engineers (IEEE®) 802.16p, 802.16n, 802.16m-2011, 802.16h-2010, 802.16j-2009, 802.16-2009. In another example, the wireless network may employ the WI-FI® technology following IEEE® 802.11 standards defined by the WI-FI ALLIANCE® such as the IEEE® 802.11-2012, IEEE® 802.11ac, or IEEE® 802.11ad standards. In another example, the electronic device may use the antenna structure to communicate with other devices using a secure WLAN, secure PAN, or a Private WAN (PWAN). Similarly, the electronic device may use the antenna structure to communicate using a BLUETOOTH® technology and IEEE® 802.15 standards defined by the BLUETOOTH® Special Interest Group, such as BLUETOOTH® v1.0, BLUETOOTH® v2.0, BLUETOOTH® v3.0, or BLUETOOTH® v4.0 (including BLUETOOTH® low energy). In another embodiment, the electronic device may use the antenna structure to communicate using a ZIGBEE® connection developed by the ZIGBEE® Alliance such as IEEE® 802.15.4-2003 (ZIGBEE® 2003), IEEE® 802.15.4-2006 (ZIGBEE® 2006), IEEE® 802.15.4-2007 (ZIGBEE® Pro). The preceding frequency bands are not intended to be limiting. The electronic device can use the antenna structure to communicate on other frequency bands, such as GNSS frequency bands (e.g., GPS frequency bands), and so forth.

FIG. 1A shows an electronic device 100 with thin borders 122, 132, 142 around a portion of a display structure 110 according to one embodiment. The electronic device 100 can include the display structure 110 coupled to a housing 105. In one example, the display structure 110 can be an electronic paper display (EPD). In another example, the display structure 110 can be a liquid crystal display (LCD) or a light emitting diode (LED) display. The display structure 110 can include a first side edge 120, a bottom edge 130, a second side edge 140, and a top edge 150. In one example, the first side edge 120, the bottom edge 130, the second side edge 140, and the top edge 150 of the housing 105 may be curved or rounded. In another example, the first side edge 120, the bottom edge 130, the second side edge 140, and the top edge 150 of the housing 105 may be squared or straight.

The electronic device 100 can have a display structure 110 with thin borders 122, 132, and 142 around three edges of the electronic device. The thin borders 122, 132, and 142 can be where the display structure 110 adjoins the housing 105 or a bezel. For example, where the display structure 110 adjoins the housing 105 or the bezel, there may be insufficient room for other components, such as antennas, to be mounted. For example, a portion of the housing 105 can surround a perimeter of the display structure 110 or can encase the display structure 110 to protect the display structure 110. The portion of the housing 105 or bezel that surrounds or encases the display structure 110 can be relatively thin, such as a 1 millimeter (mm) to 3 mm thick. It should be noted that stamping technology may go down to sub 1 mm such as 0.7 mm. For the thickest portion, it depends on internal feature for structure strength and display support. The thin borders 122, 132, and 142 can provide an appearance that the display structure is borderless or near borderless. In one example, the thin border 122 can be along the first side edge 120 of the display structure 110, the thin border 132 can be along the bottom edge 130 of the display structure 110, and thin border 142 can be along the second side edge 140 of the display structure 110.

In another example, the display structure 110 can include a dead zone 160. The dead zone 160 can be a portion of the display structure 110 that does no display information. In one example, the dead zone 160 can include various components 162 and 164 that are integrated into the display structure 110. In one example, the various components 162 and 164 can include speakers, microphone, motion sensors, cameras, and so forth. In another example, the various components 162 and 164 can include components for a tablet computing device, such as a power button, a home button, a forward button, a back button, and so forth.

Figure 1B:
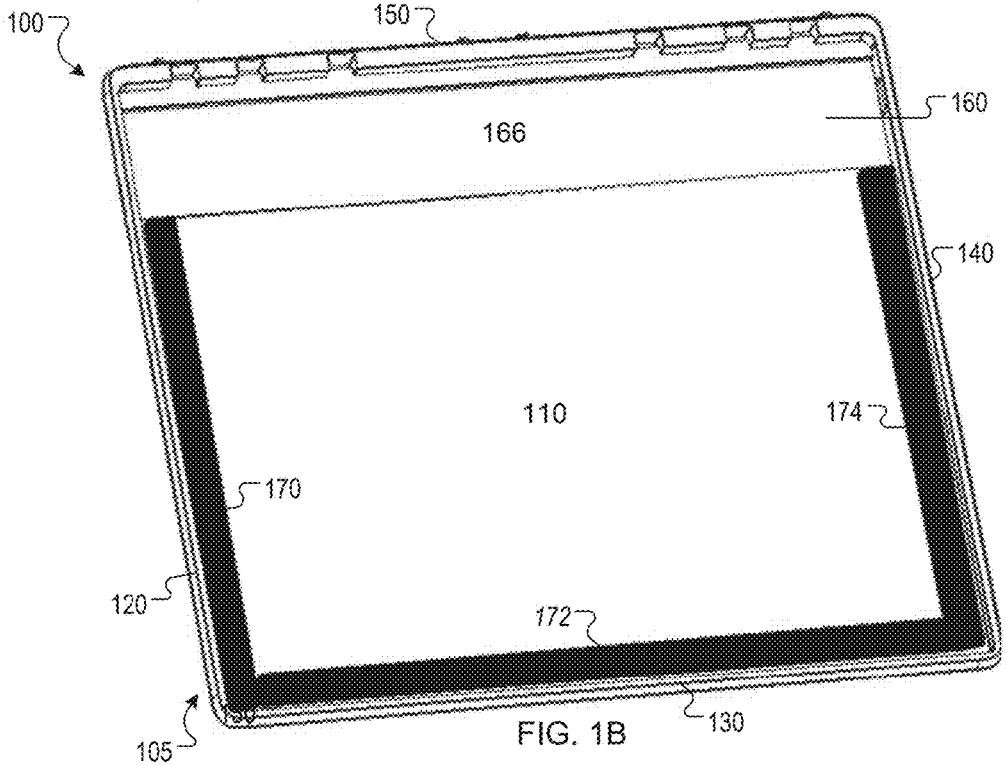
FIG. 1B shows an electronic device with touch traces or ITO traces around the display structure according to one embodiment.

FIG. 1B shows an electronic device 100 with touch traces or ITO traces 170, 172, and 174 around the display structure 110 according to one embodiment. Some components of the electronic device 100 of FIG. 1B are similar to some components of the electronic device 100 of FIG. 1A as noted by similar reference numbers unless expressly described otherwise. The ITO trace 170 can be disposed along an outer border of the display structure 110 at the first side edge 120 and is adjacent the housing 105. The ITO trace 172 can be disposed along an outer border of the display structure 110 at the bottom edge 130 and is adjacent the housing 105. The ITO trace 174 can be disposed along an outer border of the display structure 110 at the second side edge 140 and is adjacent the housing 105. The housing 105 can include a cavity 166 below at least a portion of the display structure 110 that can store components of the electronic device 100. For example, the housing 105 can include the cavity 166 below the dead zone 160 to store components of the electronic device 100, such as a communication device, speaker components, microphone components, a processor, a display controller, a touch screen controller, and so forth.

It should be noted that there may be other lossy structures other than ITO traces that integrated around the periphery of the device and is not limited to touch sensing technology or display technology.

Figure 1C:
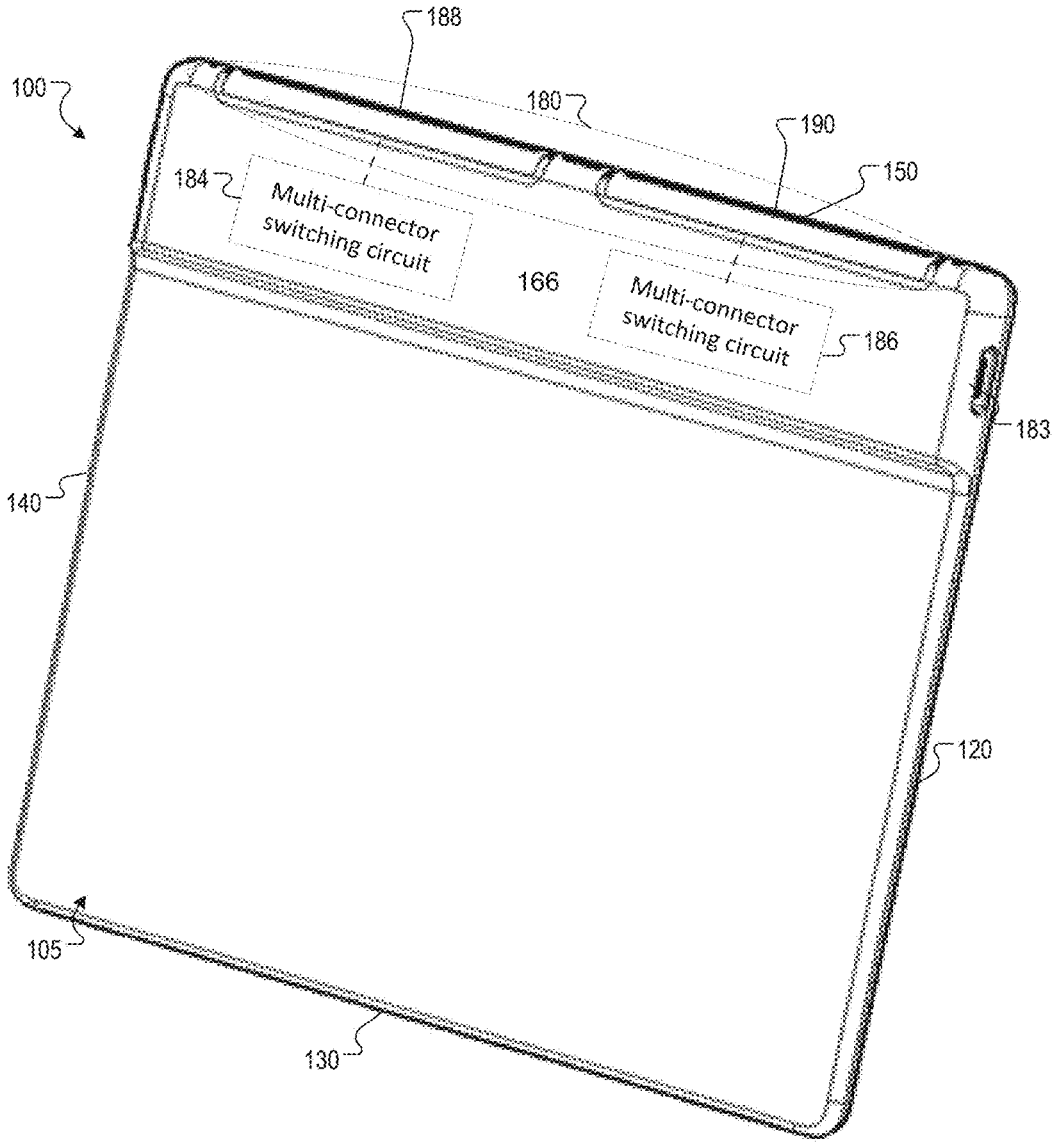
FIG. 1C shows a back view of the electronic device with an antenna structure according to one embodiment.

FIG. 1C shows a back view of the electronic device 100 with an antenna structure 180 according to one embodiment. Some components of the electronic device 100 of FIG. 1C are similar to some components of the electronic device 100 of FIGS. 1A and 1B as noted by similar reference numbers unless expressly described otherwise. The electronic device 100 can include the housing 105 with an antenna structure 180 integrated into the housing of the device along an edge of the housing 105, as discussed in greater detail in the proceeding paragraphs. In one embodiment, the antenna structure 180 is at the top edge 150 of the housing 105. In another embodiment, the antenna structure 180 can be at an edge of the cavity 166.

In one embodiment, the electronic device 100 can include a first multi-connector switching circuit 184 to configure the antenna structure 180 to use a first strip element 188 to radiate as a low-band radiator or a high-band radiator, as described here. In another embodiment, the electronic device 100 can include a second multi-connector switching circuit 186 to configure the antenna structure 180 to use a second strip element 190 to radiate as a low-band radiator or a high-band radiator, as described here An advantage of the antenna structure 180 including the first multi-connector switching circuit 184 and the second multi-connector switching circuit 186 can be to enable the electronic device 100 to communicate on multiple frequency bands.

The electronic device 100 can also include an input device 183 along an edge of the housing, such as the first side edge 120. In one example, the input device 183 can be a button to control a functionality of the electronic device 100, such as an on/off switch. In another example, the input device 183 can be an input or output port, such as a universal serial bus (USB) port or a high definition multimedia interface (HDMI) port.

Figure 2:
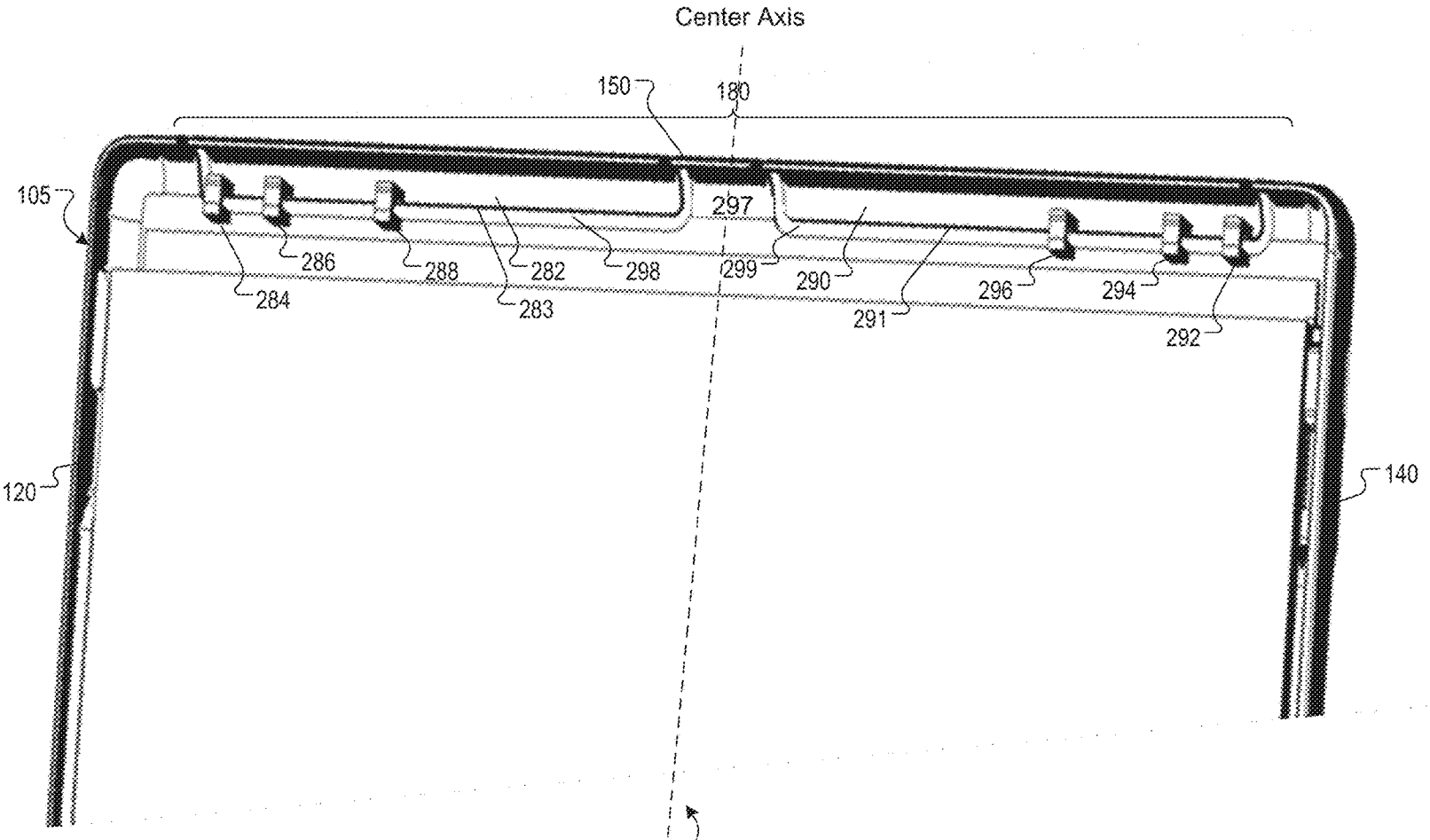
FIG. 2 shows the antenna structure of the electronic device according to one embodiment.

FIG. 2 shows the antenna structure 180 of the electronic device 100 according to one embodiment. Some components of the electronic device 100 of FIG. 2 are similar to some components of the electronic device 100 of FIGS. 1A-1C as noted by similar reference numbers unless expressly described otherwise. In one embodiment, the housing 105 can be a plastic material. In another embodiment, the housing 105 can be a metal material, such as steel, stainless steel, and so forth.

In one embodiment, the antenna structure 180 can be integrated into the housing 105. In another embodiment, the antenna structure 180 can be coupled to or attached to the housing 105 by one or more connectors. For example, the housing 105 can include the first side edge 120, the bottom edge 130, the second side edge 140, and the top edge 150 around the edges of the housing 105. The antenna structure 180 includes a first strip element 282, a second strip element 290, the first cutout 298 along the top edge 150, and the second cutout 299 along the top edge 150.

The first strip element 282 and the second strip element 290 can operate as part of the housing 105 in a structural manner. The first strip element 282 and the second strip element 290 can also be operational in a first mode of the electronic device 100, as well as in a second mode of the electronic device 100. In one example, the first mode can be an antenna mode where the antenna structure 180 can radiate as an antenna. In another example, the second mode can be a proximity sensing mode where the antenna structure 180 can determine proximity of an object or a user to the electronic device 100. In particular, the first strip element 282 and the second strip element 290 can operate as electrodes of a proximity sensing circuitry. A capacitance of the electrodes can be measured by a proximity sensing circuitry to detect a body part proximate to the first strip element, the second strip element, or both.

The first strip element 282 is physically separated from the housing 105 by a first cutout 298. The first cutout 298 can be along the periphery of the first strip element 282. In one embodiment, the first cutout 298 can be a gap between the first strip element 282 and the housing 105. In one example, the gap of the first cutout 298 can measure 1.8 millimeters (mm) in width. In another example, the gap of the first cutout 298 can measure 2 mm in width. The second strip element 290 is physically separated from the housing 105 by a second cutout 299. The second cutout 299 can be along the periphery of the second strip element 290. In one embodiment, the second cutout 299 can be a gap between the second strip element 290 and the housing 105. In one example, the gap of the second cutout 299 can measure 1.8 mm in width. In another example, the gap of the second cutout 299 can measure 2 mm in width. Alternatively, other widths may be used. The first strip element 282 is also physically separated from the second strip element 290 by a separator 297. The separator 297 can be a portion of the housing 105 that is disposed between the first strip element 282 and the second strip element 290.

The first strip element 282 can be connected to the housing 105 by a first connector 284, a second connector 286, and/or a third connector 288. In another embodiment, the first connector 284, the second connector 286, and the third connector 288 can be feed points or ground elements. The first connector 284, the second connector 286, and the third connector 288 can be disposed between an inner edge 283 of the first strip element 282 and the housing 105. A conductive path can be formed between the first strip element 282 and the first connector 284, the second connector 286, the third connector 288, or a combination thereof The second strip element 290 can be connected to the housing 105 by a fourth connector 292, a fifth connector 294, and/or a sixth connector 296. The fourth connector 292, the fifth connector 294, and the sixth connector 296 can be disposed between an inner edge 291 of the second strip element 290 and the housing 105. A conductive path can be formed between the second strip element 290 and the fourth connector 292, the fifth connector 294, and the sixth connector 296, or a combination thereof. In one embodiment, the first connector 284, the second connector 286, the third connector 288, the fourth connector 292, the fifth connector 294, and the sixth connector 296 can be capacitors, resistors, inductors, or a combination thereof. In another embodiment, the first connector 284, the second connector 286, the third connector 288, the fourth connector 292, the fifth connector 294, and the sixth connector 296 can be feed points, conductors, hex connectors, or ground elements. In one example, the connectors 284-288 and 292-296 can be small capacitors (such as 10 pico-farad (pf) capacitors) that may be suitable at very low frequency to work as proximity sensor pad, as described herein. The first connector 284, the second connector 286, and the third connector 288 can be adjusted to change an electrical length of the first strip element 282. The fourth connector 292, the fifth connector 294, and the sixth connector 296 can be adjusted to change an electrical length of the second strip element 290.

A switching circuit can change a radiation pattern of the antenna structure 180 by changing the current flow on the first strip element 282 or the second strip element 290 using the first connector 284, the second connector 286, the third connector 288, the fourth connector 292, the fifth connector 294, the sixth connector 296, or a combination thereof. The first connector 284, the second connector 286, the third connector 288, the fourth connector 292, the fifth connector 294, or the sixth connector 296 may be discrete components with a capacitive value or may be conductive traces with the corresponding capacitance value. In one embodiment, the first connector 284, the second connector 286, the third connector 288, the fourth connector 292, the fifth connector 294, or the sixth connector 296 can have capacitance values of 2 pico-farads (pF). This type of capacitance value gives a very small loading effect when in the proximity sensing mode, but provides the antenna structure 180 effect in the antenna mode.

The electronic device 100 can include the switching circuit to configure the antenna structure 180 to resonate as a dipole antenna at a low frequency band, a WLAN frequency band, and at a high frequency band, as discussed in greater detail in the proceeding paragraphs. In one embodiment, the switching circuit can connect the first strip element 282 to the housing 105 using one or more of the connectors 284-288. In another embodiment, the switching circuit can connect the second strip element 290 to the housing 105 using one or more of the connectors 292-296. In another embodiment, the first strip element 282 and the second strip element 290 can be metal strips on the metal housing 105 of the electronic device 100. In another embodiment, the first strip element 282 and the second strip element 290 can be stamped metal.

In one embodiment, the switching circuit can connect the first strip element 282 to the connector 286 to configure the first strip element for impedance pre-matching. In another embodiment, the switching circuit can connect the second strip element 290 to the connector 294 to configure the second strip element 290 for impedance pre-matching. For example, the first strip element 282 can be a first monopole radiator and the second strip element 290 can be a second monopole radiator. The first and second monopole radiators can be combined to radiate at the low band or the high band. To radiate at the low band or the high band, the first strip element 282 and the second strip element 290 can be pre-matched. In this example, the impedance pre-matching involve electrical tuning of the first strip element 282 and the second strip element 290 and performing an impedance matching at a feed-point or a centerline of the combined monopole radiators. In one embodiment, the feed-point is disposed along a centerline of the combined monopole radiators. After the pre-matching, the switching circuit can configure the first strip element 282 and the second strip element 290 to resonate at the low-band frequency range or the high-band frequency range. For example, the connectors 284 and 292 can be inductors whose inductance can be connected to the first strip element 282 and the second strip element 290, respectively, to configure the antenna structure 180 to resonate at the low-band frequency range or a WLAN band frequency range. In one embodiment, the low-band frequency range can be a frequency range of approximately 700 megahertz (MHz) to 760 MHz. In another embodiment, the WLAN band frequency range can be a frequency range of approximately 2.4 gigahertz (GHz) to 2.5 GHz. In another example, the connectors 288 and 296 can be inductors whose inductance that can be connected to the first strip element 282 and the second strip element 290, respectively, to configure the antenna structure 180 to resonate at the high-band frequency range. In another embodiment, the high-band frequency range can be a WAN frequency range, such as a frequency range of approximately 1.65 GHz to 1.75 GHz or 2.0 GHz to 2.15 GHz.

In one embodiment, the first cutout 298 and the second cutout 299 are disposed at symmetric locations on a side of the electronic device 100 relative to a center point or a center axis on the side of the electronic device 100. For example, the first cutout 298 and the second cutout 299 can be located along a top edge 150 (FIGS. 1A and 1B) of the housing 105 around the center axis. In this example, the first cutout 298 and the second cutout 299 can be at equidistance locations from the center axis. In another embodiment, the first cutout 298 and the second cutout 299 are disposed at non-symmetric locations along the first side of the electronic device 100, such as the top edge 150 of the housing 105.

In one example, the first strip element 282, the second strip element 290, the first cutout 298, and the second cutout 299 can be located along one of the first side edge 120, the bottom edge 130, the second side edge 140, or the top edge 150. In one embodiment, the first strip element 282 and the second strip element 290 can be the same length. For example, the first strip element 282 and the second strip element 290 can each be 44 mm. Alternatively, the first strip element 282 and the second strip element 290 can each be between approximately 58 mm to approximately 65 mm. In another embodiment, the first strip element 282 and the second strip element 290 can be different lengths. For example, the first strip element 282 can be 42 mm and the second strip element 290 can be 46 mm. The length and location of the first strip element 282 and the second strip element 290 can vary and the preceding embodiments and examples are exemplary and not intended to be limiting.

The embodiments described herein can also utilize the strip elements of the antenna structure 180 as a proximity sensor. The strip elements can be considered capacitors of which the capacitance can be measured by a proximity sensing circuit. An advantage of the electronic device using the strip elements as part of the antenna structure 180 and as part of the proximity sensor can be to integrate the antenna structure 180 and the proximity sensor into the same structure of the electronic device.

Figure 3A:
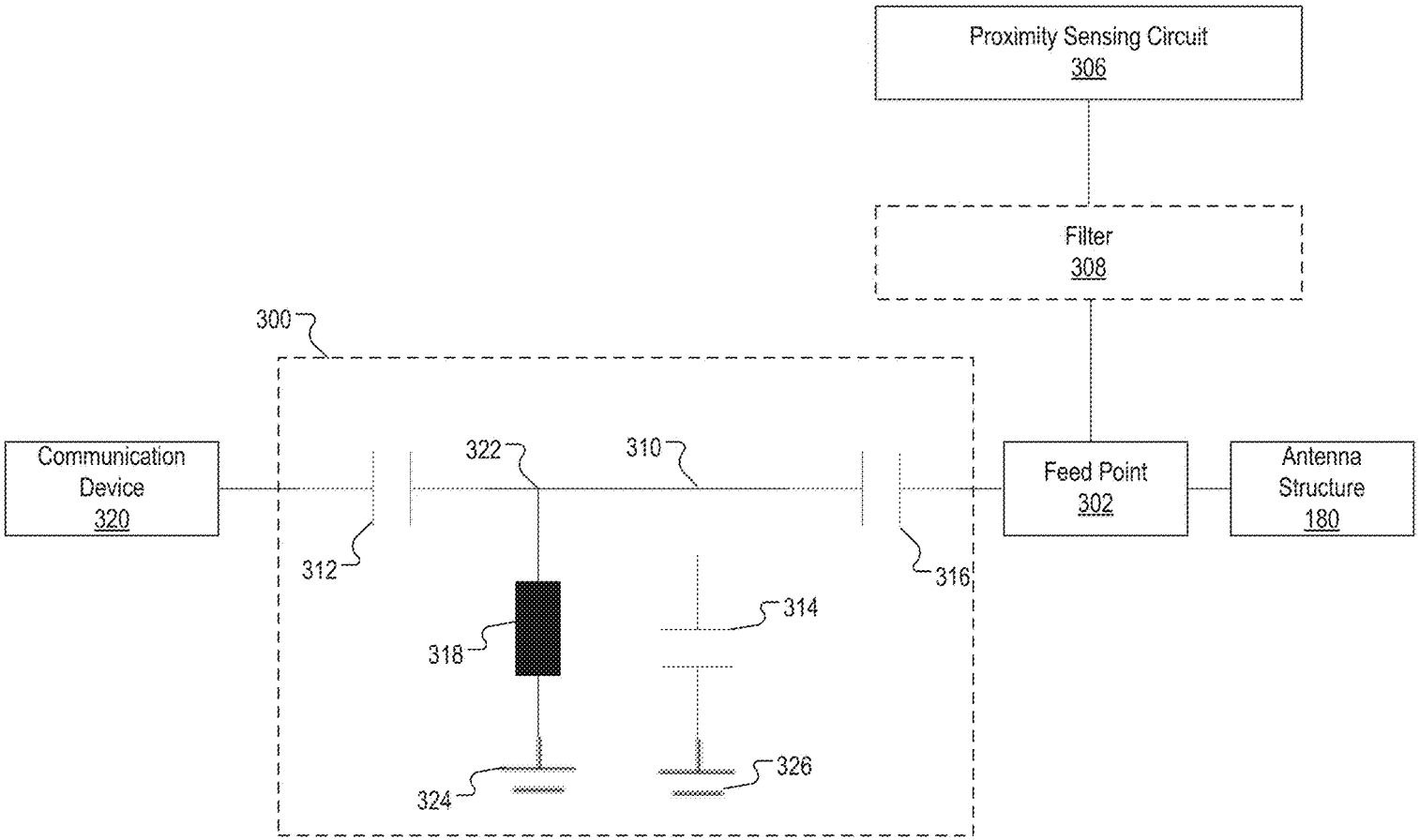
FIG. 3A is a schematic diagram of an impedance matching circuitry according to one embodiment.

FIG. 3A is a schematic diagram of an impedance matching circuitry 300 according to one embodiment. The impedance matching circuitry 300 can be disposed in-line with a feed point 302 and the antenna structure 180 (FIG. 2). The impedance matching circuitry 300 can also be disposed before the feed point 302 on a circuit board where radio frequency (RF) circuitry resides. The impedance matching circuitry 300 can be used for the pre-matching, as discussed in the preceding paragraphs. In one embodiment, the impedance matching circuitry 300 includes series capacitors 312, 314, 316 and a shunt inductor 318. The first series capacitor 312 is coupled between a communication device 320 and a first intermediate node 322. In another embodiment, the impedance matching circuitry 300 can include different combinations of matching components in parallel or in series. For example, in one example, the communication device 320 can be a WAN device, a modem, or other antenna circuitry.

The shunt inductor 318 is coupled between the first intermediate node 322 and a first ground 324. The second series capacitor 314 is coupled between the second intermediate node 310 and a second ground 326. The third series capacitor 316 is coupled between the second intermediate node 310 and the feed point 302. The antenna structure 180 is coupled to the feed point 302. In one embodiment, the impedance matching circuitry 300 may be disposed on a printed circuit board (PCB). In the depicted embodiment, the impedance matching circuitry 300 can be a simple matching T circuitry and can be used to further enlarge the bandwidth of the antenna structure 180. Alternatively, other components and other configurations of components may be used for matching the antenna structure 180 in other ways.

In another embodiment, a proximity sensing circuitry 306 can be coupled to the antenna structure 180 via the filter 308. In one example, the filter 308 can be a low-pass filter. In another example, the filter 308 can be an inductor. Alternatively, the proximity sensing circuitry 306 can be coupled to the antenna structure 180 without the filter 308. The filter 308 may operate to filter signals from the RF circuitry driven at the feed point 302. Alternatively, other configurations of the RF circuitry and proximity sensing circuitry 306 may be utilized for the antenna structure 180. In one embodiment, the antenna structure 180 can be switched between an antenna mode and a proximity sensing mode. In another embodiment, the antenna structure 180 can operate concurrently in the antenna mode and the proximity sensing mode because the proximity sensing mode operates at a lower frequency than the antenna mode. In another example, the antenna structure 180 can operate at the same time at different frequency bands (e.g., a low frequency band and a high frequency band).

FIGS. 3B-3E illustrates example impedance matching circuits that can be used for integration of the proximity sensing circuitry into the antenna structure according to various embodiments. The impedance matching circuit is used to prohibit the RF feed point from the ground potential of the proximity sensing circuitry. The communication device is on the left and the feed point is on the right in these circuit diagrams.

A switch can control the coupling of the RF circuitry and the proximity sensing circuitry 306 to the antenna structure 180. Alternatively, matching components can be used to permit both the proximity sensing circuitry 306 and the RF circuitry to be coupled to the antenna structure 180 via the feed point 302. The matching components can move an impedance of the antenna on Smith chart to around the center of the Smith chart.

In one embodiment, the RF circuitry includes the communication device 320. In one example, the communication device can be a WAN module. The WAN module is operable to cause the feed point 302 and the antenna structure 180 to radiate electromagnetic energy in a first frequency range (such as approximately 0.7 MHz to 0.76 MHz) in a first resonant mode, a second frequency range (such as approximately 2.4 GHz to 2.5 GHz) in a second resonant mode, or a third frequency range (such as approximately 1.65 GHz to 1.75 GHz or 2.0 GHz to 2.15 GHz) in a third resonant mode. It should be noted that the second frequency range may be a third harmonic of the first frequency range. In another embodiment, the RF circuitry may include other modules, such as a WLAN module, a PAN module, a GNSS module (e.g., a GPS module), and so forth.

For example, the WLAN module may include a WLAN RF transceiver for communication on one or more Wi-Fi® bands (e.g., 2.4 GHz and 5 GHz). It should be noted that the Wi-Fi® technology is the industry name for wireless local area network communication technology related to the IEEE® 802.11 family of wireless networking standards by the Wi-Fi ALLIANCE®. For example, a dual-band WLAN RF transceiver allows an electronic device to exchange data or connection to the Internet wirelessly using radio waves in two WLAN bands (2.4 GHz band, 5 GHz band) via one or multiple antennas. For example, a dual-band WLAN RF transceiver includes a 5 GHz WLAN channel and a 2.4 GHz WLAN channel.

The antenna architecture may include additional RF modules and/or other communication modules, such as a WLAN module, a GPS receiver, a near field communication (NFC) module, an amplitude modulation (AM) radio receiver, a frequency modulation (FM) radio receiver, a PAN module (e.g., Bluetooth® module, Zigbee® module), a GNSS receiver, and so forth. The RF circuitry may include one or multiple RF front-end (RFFE) circuitries (also referred to as RF circuit). The RFFEs may include receivers and/or transceivers, filters, amplifiers, mixers, switches, and/or other electrical components. The RF circuitry may be coupled to a modem that allows the electronic device 100 (FIG. 1A or 1B) to handle both voice and non-voice communications (such as communications for text messages, multimedia messages, media downloads, web browsing, etc.) with a wireless communication system. The modem may provide network connectivity using any type of digital mobile network technology including, for example, LTE, LTE advanced (4G), CDPD, GPRS, EDGE, UMTS, 1×RTT, EVDO, HSDPA, WLAN (e.g., Wi-Fi® network), etc. In the depicted embodiment, the modem can use the RF circuitry to radiate electromagnetic energy from the antennas to communication data to and from the electronic device 100 (FIG. 1A or 1B) in the respective frequency ranges. In other embodiments, the modem may communicate according to different communication types (e.g., WCDMA, GSM, LTE, CDMA, WiMAX, etc.) in different cellular networks. Additional details regarding the current follow for the resonance are described below with respect to FIGS. 4A, 4B, 5A, 5B, 6A, 6B, 7A, and 7B.

In another embodiment, the electronic device 100 can include a switch coupled between the RF circuitry and the feed point 302, where the switch can change the electronic device 100 between an antenna mode and a proximity sensing mode. The electronic device 100 further includes the proximity sensing circuitry 306 coupled to the switch. The proximity sensing circuitry 306 can be operable to measure a capacitance of the first strip element 282, the second strip element 290, or a combination thereof in the proximity sensing mode. In a further embodiment, the electronic device 100 can switch from the antenna mode to a proximity sensing mode and use the proximity sensing circuitry 306 to measure a capacitance of the first strip element 282, the second strip element 290, or a combination thereof to detect an object proximate to the first strip element 282 or the second strip element 290. The first strip element 282 and the second strip element 290 can be operable to radiate the electromagnetic energy as part of the antenna mode.

Figure 4A:
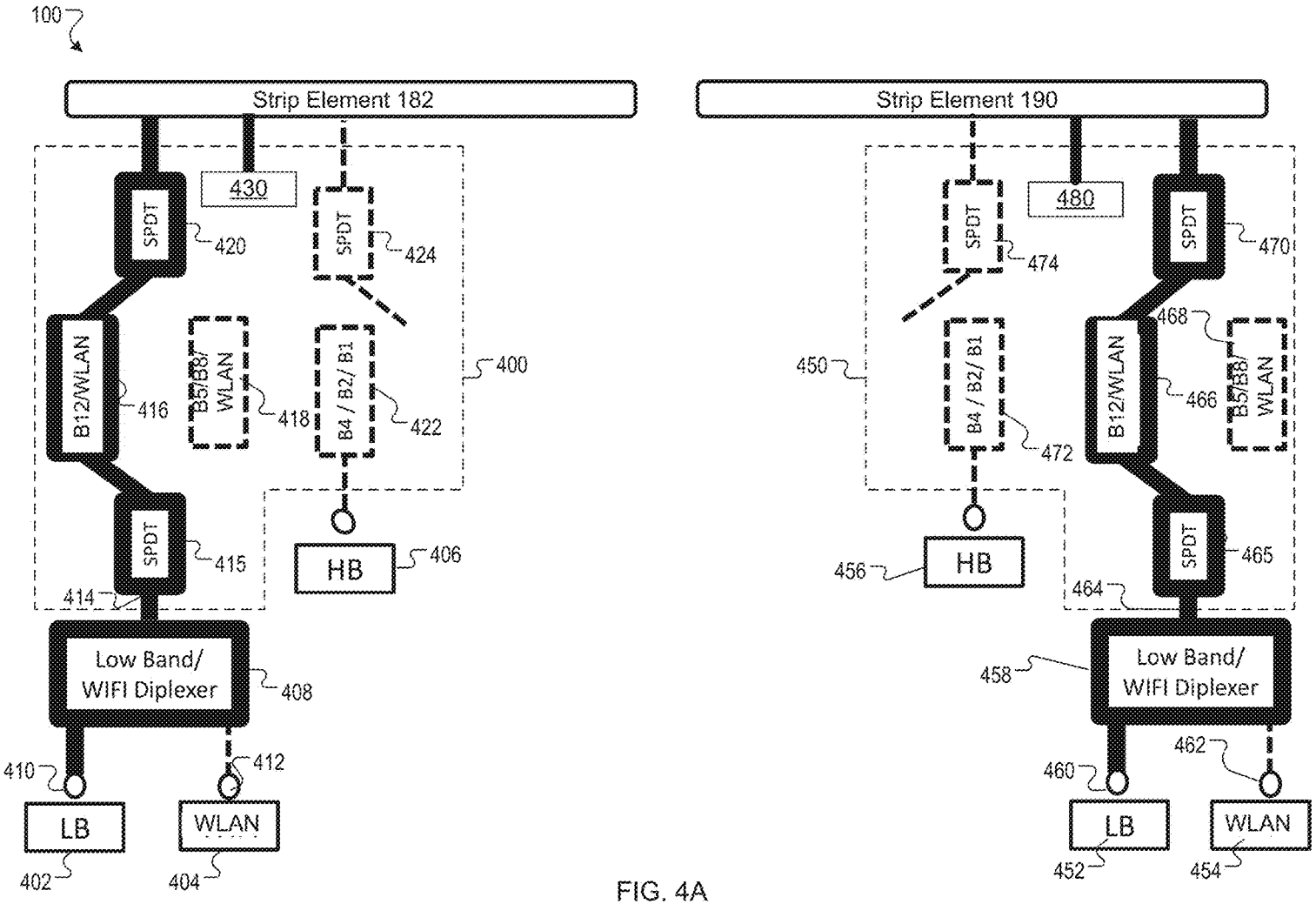
FIG. 4A illustrates a switching circuit of the electronic device operable to configure the antenna structure to communicate on the wireless local area network (WLAN) frequency band or a wide area network (WAN) frequency band according to one embodiment.

FIG. 4A illustrates a multi-connector switching circuitry 400 of the electronic device 100 (FIG. 1A or 1B) operable to configure the antenna structure 180 (FIG. 2) to communicate on a Wi-Fi® frequency band or a B12 LTE frequency band according to one embodiment. For simplicity, the description below discusses the components of the multi-connector switching circuitry 400 that are coupled to strip element 182. The components of the second multi-connector switching circuitry 4500 that are coupled to strip element 190 operate in a similar manner as noted in parenthesis. In one embodiment, the electronic device can include a first feed point 402 (452), a second feed point 404 (454), and a third feed point 406 (456). The feed points 402-406 (452-456) can feed radio waves to the first strip element 182 (190). The feed points 402-406 (452-456) can collect incoming radio waves from the first strip element 182 (190) and convert the radio waves to electric currents and transmit them to a receiver of the electronic device 100. The first feed point 402 (452) can be for low frequency band radio waves. The second feed point 404 (454) can be for WLAN frequency band radio waves. The third feed point 406 (456) can be for high frequency band radio waves. In one embodiment, the multi-connector switching circuitry 400 includes a first input node coupled to the first RF feed (first feed point 402), a second input node coupled to the second RF feed (second feed point 404), a third input node coupled to the third RF feed (third feed point 406), a first output node coupled to the first connector 284, and a second output node coupled to the second connector 288.

In another embodiment, the antenna structure includes the first strip element, the second strip element, and a first connector coupled to the first strip element at a first location, a second connector coupled to the first strip element at a second location, a third connector coupled to the second strip element at a third location, and a fourth connector coupled to the second strip element at a fourth location. The first multi-connector switching circuitry comprising: a first input node coupled to the first RF feed; a second input node coupled to the second RF feed; a third input node coupled to the third RF feed; a first output node coupled to the first connector, and a second output node coupled to the second connector. The second multi-connector switching circuitry comprising: a first input node coupled to the first RF feed; a second input node coupled to the second RF feed; a third input node coupled to the third RF feed; a first output node coupled to the third connector, and a second output node coupled to the fourth connector. The RF circuitry is operable to control the second multi-connector switching circuitry to connect any one of the first, second, and third RF feeds to any one of the third and fourth connectors. In a further embodiment, the first multi-connector switching circuitry is operable to connect the first RF feed to first connector of the first strip element in a first mode, to connect the second RF feed to the first connector of the first strip element in a second mode, and to connect the third RF feed to the second connector of the first strip element in a third mode. The second multi-connector switching circuitry is operable to connect the first RF feed to third connector of the second strip element in the first mode, to connect the second RF feed to the third connector of the second strip element in the second mode, and to connect the third RF feed to the fourth connector of the second strip element in the third mode.

In the depicted embodiment, the multi-connector switching circuitry 400 can include a single pole, double throw (SPDT) switches 415 (465), 420 (470), and 424 (474) and impedance matching circuits 416, 418, and 422 (466, 468, and 472). In one embodiment, the electronic device 100 can include a diplexer 408 (second diplexer 458) coupled between the feed points 402 and 404 (452 and 454) and a single pole, double throw (SPDT) switch 415 (465). The diplexer 408 (458) is a frequency-domain multiplexor. A first port of the diplexer 408 (458) is connected to the first feed point 402 (452), a second port 412 (462) of the diplexer 408 (458) is connected to the second feed point 404 (454), and a third port 414 (464) of the diplexer 408 (458) is connected to the SPDT switch 415 (465) of the multi-connector switching circuitry 400 (450). The radio waves from the first port 410 (460) and the second port 412 (462) are multiplexed onto the third port 414 (464). The radio waves on ports 410 and 412 (460 and 462) can occupy disjoint frequency bands, such as low-band frequencies and WLAN frequencies. The radio waves on the low-band frequencies and WLAN frequencies can coexist at the port 414 (464) without interfering with each other. In another example, the diplexer 408 (458) can be a combiner or splitter.

The multi-connector switching circuitry 400 can include impedance matching circuits, such as the B12/WLAN impedance matching circuit 416 (466) and the B5/B8/WLAN impedance matching circuit 418 (468). The impedance matching circuits can be diplexers that define different paths to the first and second strip elements 182 and 190 for different frequencies. The B12/WLAN impedance matching circuit 416 (466) and the B5/B8/WLAN impedance matching circuit 418 (468) can be couple between the SPDT switch 415 (465) and the SPDT switch 420 (470). The SPDT switch 415 (465) can toggle between the B12/WLAN impedance matching circuit 416 (466) and the B5/B8/WLAN impedance matching circuit 418 (468). The SPDT switch 420 (470) can toggle between the B12/WLAN impedance matching circuit 416 (466) and the B5/B8/WLAN impedance matching circuit 418(468). The SPDT switch 420 (470) can be coupled between the B12/WLAN impedance matching circuit 416 (466) and the B5/B8/WLAN impedance matching circuit 418 (468) and the strip element 182 (FIG. 1) or 282 (FIG. 2). A processor or a general-purpose input/output (GPIO) circuit can configure the SPDT switch 415 (465) and the SPDT switch 420 (470) of the multi-connector switching circuitry 400 (second multi-connector switching circuitry 45) in a first mode to connect the first feed point 402 and the second feed point 404 to the first strip element 282 and send and receive radio waves on the B12 and WLAN frequency bands.

In one embodiment, the first connector 284 of FIG. 2 is coupled SPDT 420, the second connector 286 is coupled to a first pre-matching circuit 430, and the third connector 288 is coupled to SPDT 424. Similarly, the fourth connector fourth connector 292 is coupled to SPDT 470, the fifth connector 294 is coupled to a second pre-matching circuit 480, and the sixth connector 296 is coupled to SPDT 474. The first pre-matching circuit 430 is coupled between the first strip element and ground. The first pre-matching circuit 430 is coupled between the second strip element and ground.

In one embodiment, the GPIO can be coupled to a modem of the electronic device 100 and the modem can determine a configuration of the multi-connector switching circuitry 400. In another embodiment, the GPIO can be coupled to a processor of the electronic device 100 and the processor can determine a configuration of the multi-connector switching circuitry 400. The processor or the modem can select a low band or a high band for communication based on a received signal strength indicator (RSSI) of the low band or high band. For example, when the RSSI of the low band is stronger than the RSSI of the high band, the processor or the modem can select the low band. In another example, when the RSSI of the high band is stronger than the RSSI of the low band, the processor or the modem can select the high band. In another example, the electronic device 100 can receive a command from a base station on a cellular network or a WLAN network that can indicate the frequency band to use for communication and the processor or modem of the electronic device 100 can configure the multi-connector switching circuitry 400 for that frequency band.

The feed point 406 can be coupled to the B4/B2/B1 impedance matching circuit 422. The B4/B2/B1 impedance matching circuit 422 can be coupled between the feed point 406 and a SPDT switch 424. The SPDT switch 424 can be coupled between the B4/B2/B1 impedance matching circuit 422 and the first strip element 282. The SPDT 424 can have an on mode where the SPDT switch connects the third feed point 406 via the B4/B2/B1 impedance matching circuit 422 to the first strip element 282. The SPDT 424 can also have an off mode where the SPDT switch disconnects the third feed point 406 via the B4/B2/B1 impedance matching circuit 422 from the first strip element 282. In one embodiment, the antenna structure 180 is configured to communicate on a Wi-Fi® frequency band or a B12 LTE frequency band. In this embodiment, the SPDT 415 switch is connected to the B12/WLAN impedance matching circuit 416 and the SPDT switch 420 is connected to the B12/WLAN impedance matching circuit 416 to connect the first feed point 402 and the second feed point 404 to the first strip element 282. Additionally, when the antenna structure 180 is configured to communicate using a Wi-Fi® communications channel or a B12 LTE frequency band, the SPDT 424 switch is in the off mode so that the third feed point 406 is not connected to the first strip element 282. In one embodiment, the antenna structure 180 can be configured to use the first strip element 282 to communicate on a first frequency band (such as a WLAN frequency band) and the second strip element 290 can be used to communicate on a second frequency band (such as a LTE frequency band).

Figure 4B:
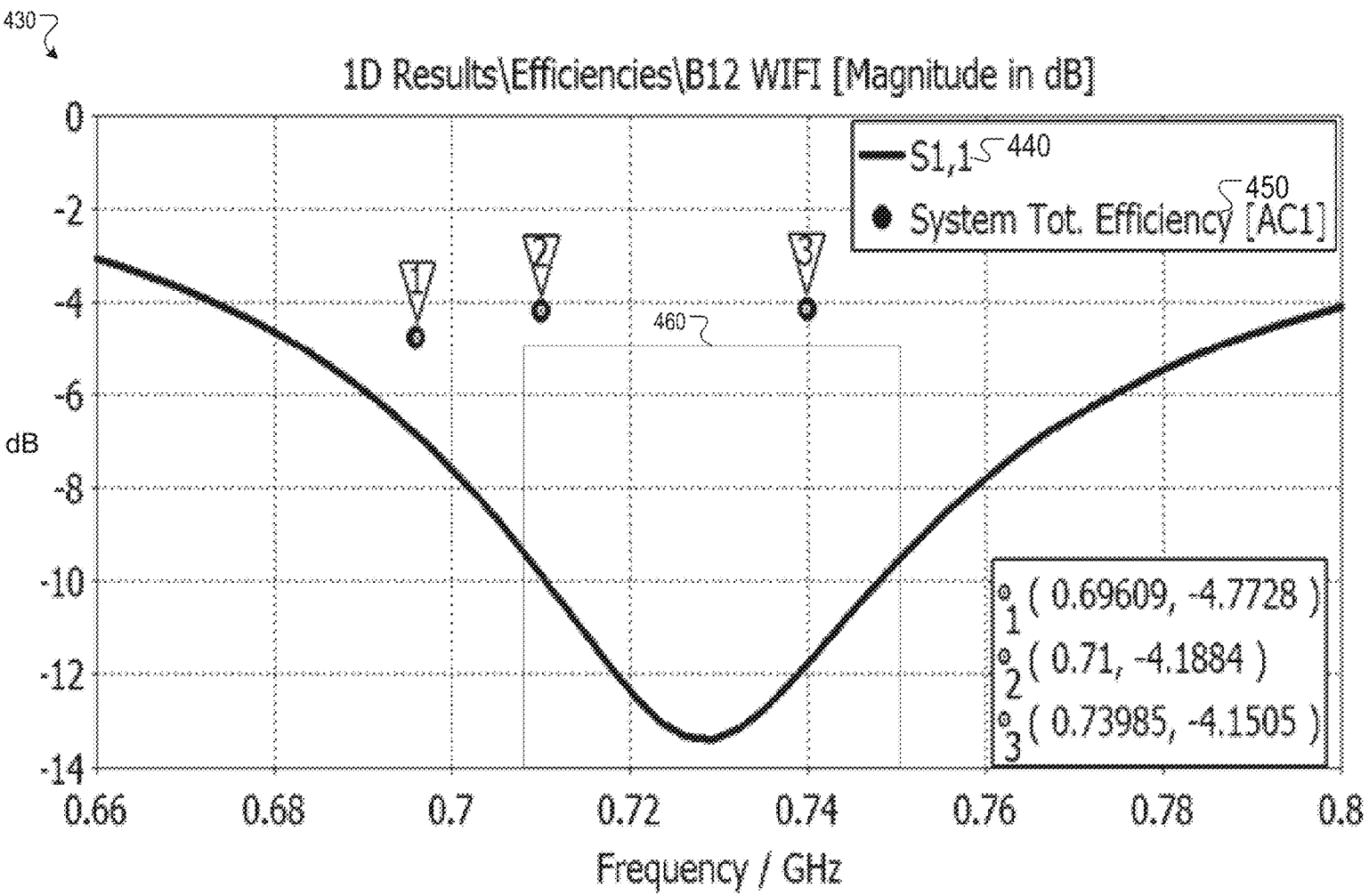
FIG. 4B shows a graph of the $S_{11}$ parameter and a total system efficiency of an antenna structure according to one embodiment.

FIG. 4B shows a graph 430 of the S11 parameter 440 and a total system efficiency 450 of the antenna structure 180 of FIG. 2 according to one embodiment. The graph 430 shows the S11 parameter 440 of the antenna structure 180 in a low band (LB) 460. The S11 parameter 440 is measured in decibels (dB). In one embodiment, the LB 460 covers a frequency range between approximately 710 MHz and approximately 750 MHz, such as for B12/B17 LTE frequency band. Alternatively, other frequencies in the LB 460 may be covered by the antenna structure 180 configured for the low frequency band. The graph 430 shows the total system efficiency parameter 450 of the antenna structure 180 in the LB 460. The total system efficiency parameter 450 is measured in dB. The graph 430 further shows a reflection coefficient of the antenna structure 180 when using a component matching network. The frequency range of the antenna structure 180 is not intended to be limiting. The antenna structure 180 can communicate using other frequency bands.

Figure 5A:
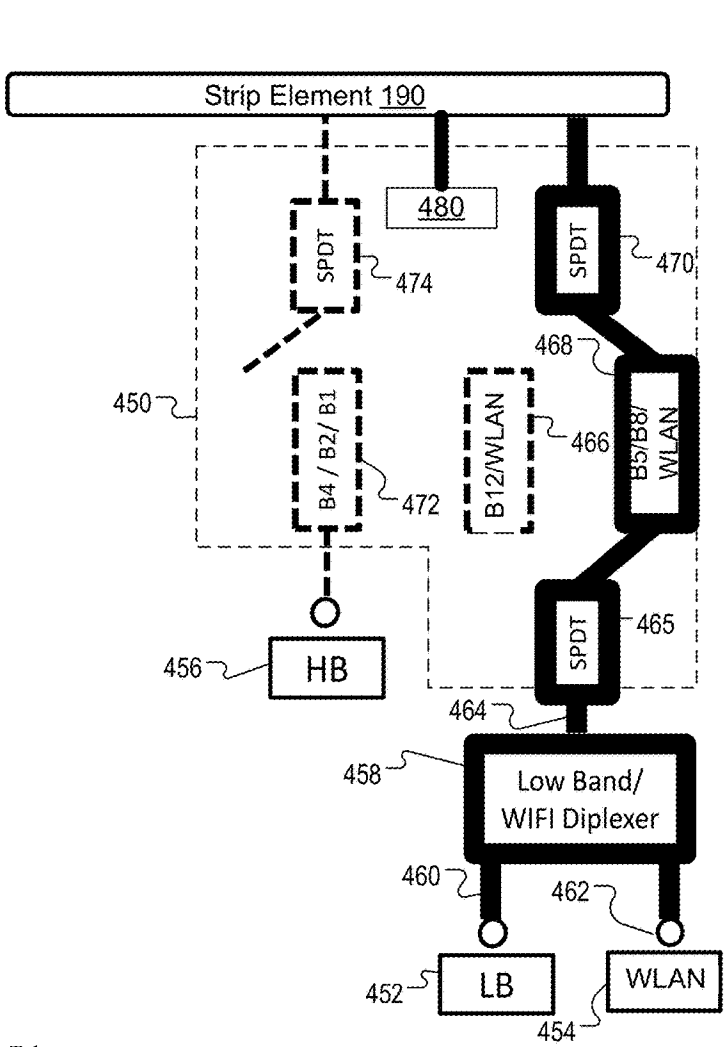
FIG. 5A illustrates a switching circuit of the electronic device operable to configure the antenna structure to communicate on the WLAN frequency band or a WAN frequency band according to one embodiment.
Figure 5A:
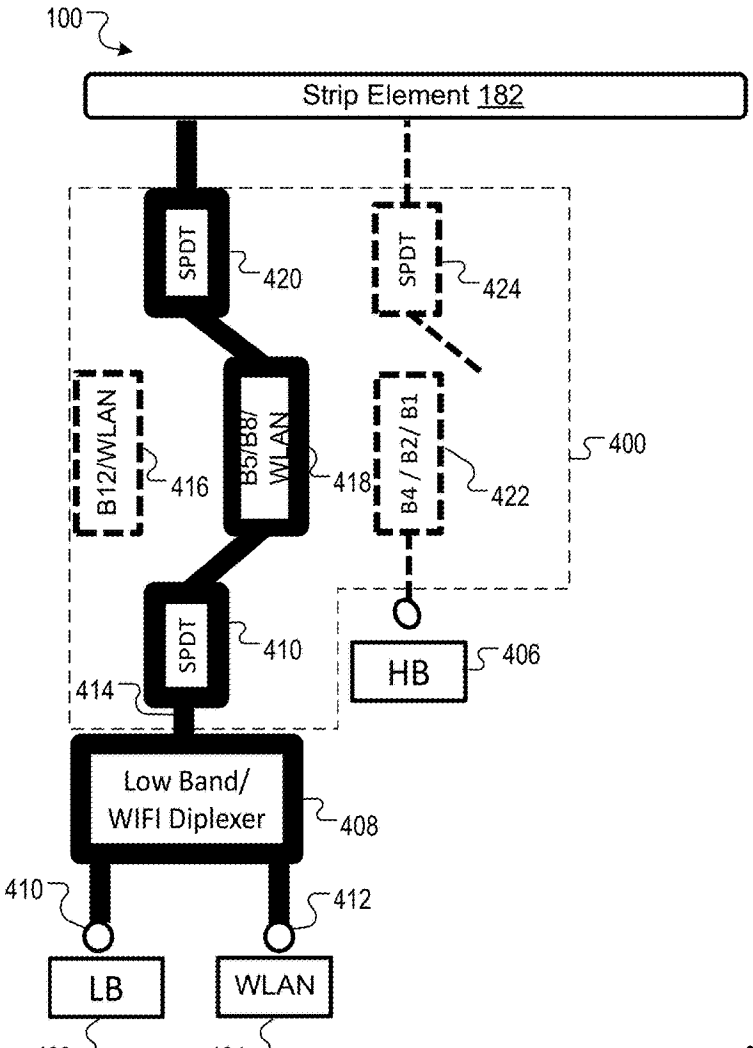

FIG. 5A illustrates a multi-connector switching circuitry 400 of the electronic device 100 (FIG. 1A or 1B) operable to configure the antenna structure 180 (FIG. 2) to communicate on a WLAN frequency band (e.g., using Wi-Fi® technology) or a B5/B8 LTE frequency band according to one embodiment. Some components of the multi-connector switching circuitry 400 of FIG. 5A are similar to some components of the multi-connector switching circuitry 400 of FIG. 4A as noted by similar reference numbers, unless expressly described otherwise. In one embodiment, the antenna structure 180 is configured to communicate on a Wi-Fi® frequency band or a B5/B8 LTE frequency band, the SPDT 415 switch is connected to the B5/B8/WLAN impedance matching circuit 418 and the SPDT switch 420 is connected to the B5/B8/WLAN impedance matching circuit 418 to connect the first feed point 402 and the second feed point 404 to the first strip element 282, e.g., a second mode of the multi-connector switching circuitry 400. Additionally, when the antenna structure 180 is configured to communicate on a Wi-Fi® frequency band or a B5/B8 LTE frequency band, the SPDT 424 switch is in the off mode so that the third feed point 406 is not connected to the first strip element 282.

Figure 5B:
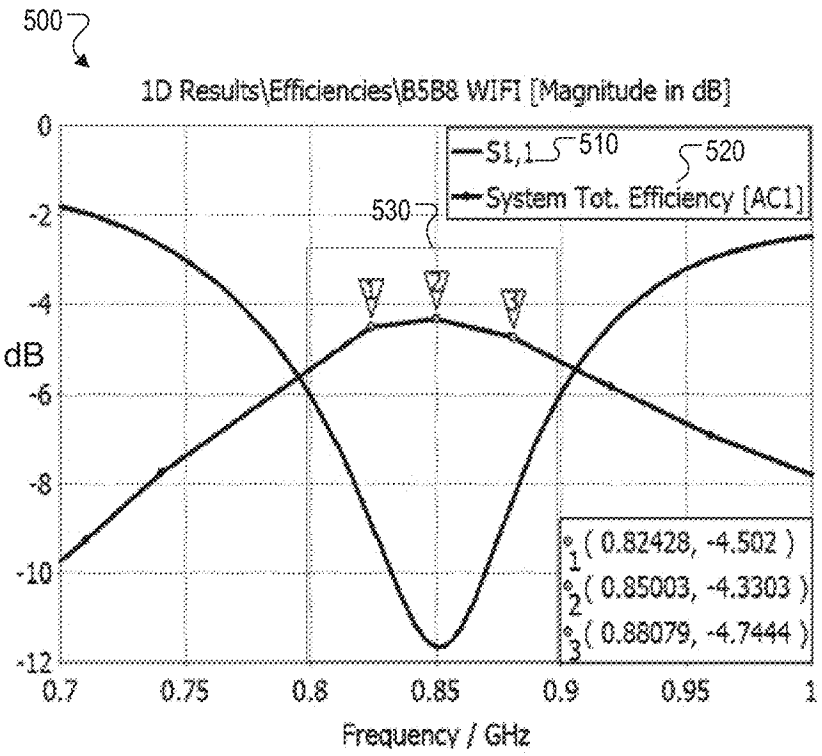
FIG. 5B shows another graph of the $S_{11}$ parameter and a total system efficiency of an antenna structure according to one embodiment.

FIG. 5B shows a graph 500 of the S11 parameter 510 and a total system efficiency parameter 520 of the antenna structure 180 of FIG. 2 according to one embodiment. The graph 500 shows the S11 parameter 510 of the antenna structure 180 in a LB 530. The S11 parameter 510 is measured in dB. In one embodiment, the LB 530 covers a frequency range between approximately 800 MHz and approximately 900 MHz, such as for B5/B8 LTE frequency band. Alternatively, other frequencies in the LB 530 may be covered by the antenna structure 180 configured for the low frequency band. The graph 500 shows the total system efficiency parameter 520 of the antenna structure 180 in the LB 530. The total system efficiency parameter 520 is measured in dB. The graph 500 further shows a reflection coefficient of the antenna structure 180 when using a component matching network. The frequency range of the antenna structure 180 is not intended to be limiting. The antenna structure 180 can communicate using other frequency bands.

Figure 5C:
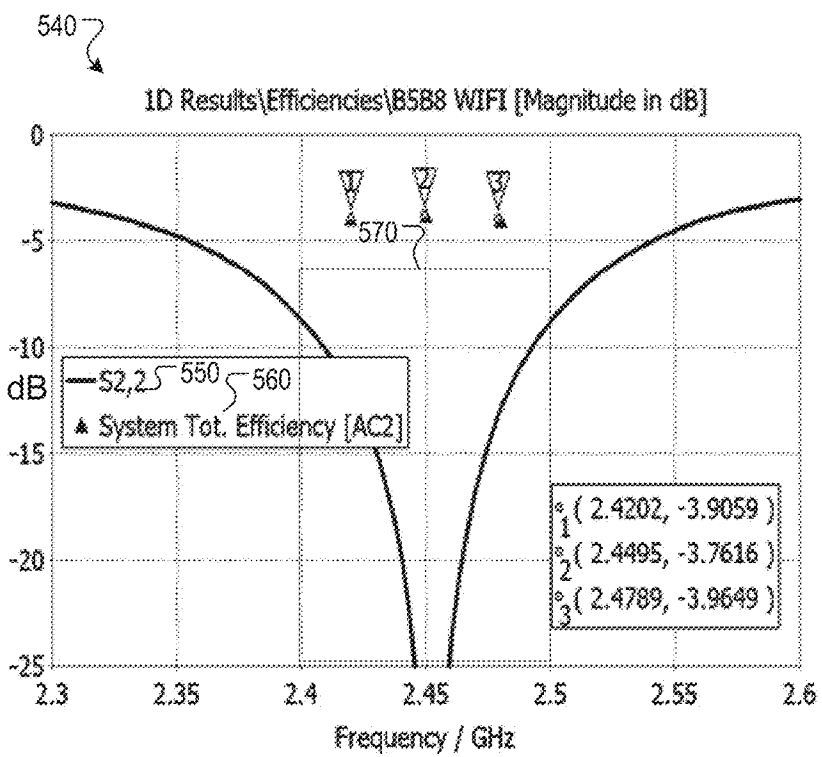
FIG. 5C shows a graph of the S2 parameter and a total system efficiency parameter of the antenna structure of FIG. 2 according to one embodiment.

FIG. 5C shows a graph 540 of the S2 parameter 550 and a total system efficiency parameter 560 of the antenna structure 180 of FIG. 2 according to one embodiment. The graph 500 shows the S22 parameter 550 of the antenna structure 180 in a LB 570. The S22 parameter 550 is measured in dB. In one embodiment, the LB 570 covers a frequency range between approximately 2.4 GHz and approximately 2.5 GHz, such as for Wi-Fi® frequency band. Alternatively, other frequencies in the LB 570 may be covered by the antenna structure 180 configured for the low frequency band. The graph 540 shows the total system efficiency parameter 560 of the antenna structure 180 in the LB 570. The total system efficiency parameter 560 is measured in dB. The graph 540 further shows a reflection coefficient of the antenna structure 180 when using a component matching network. The frequency range of the antenna structure 180 is not intended to be limiting. The antenna structure 180 can communicate using other frequency bands.

Figure 6A:
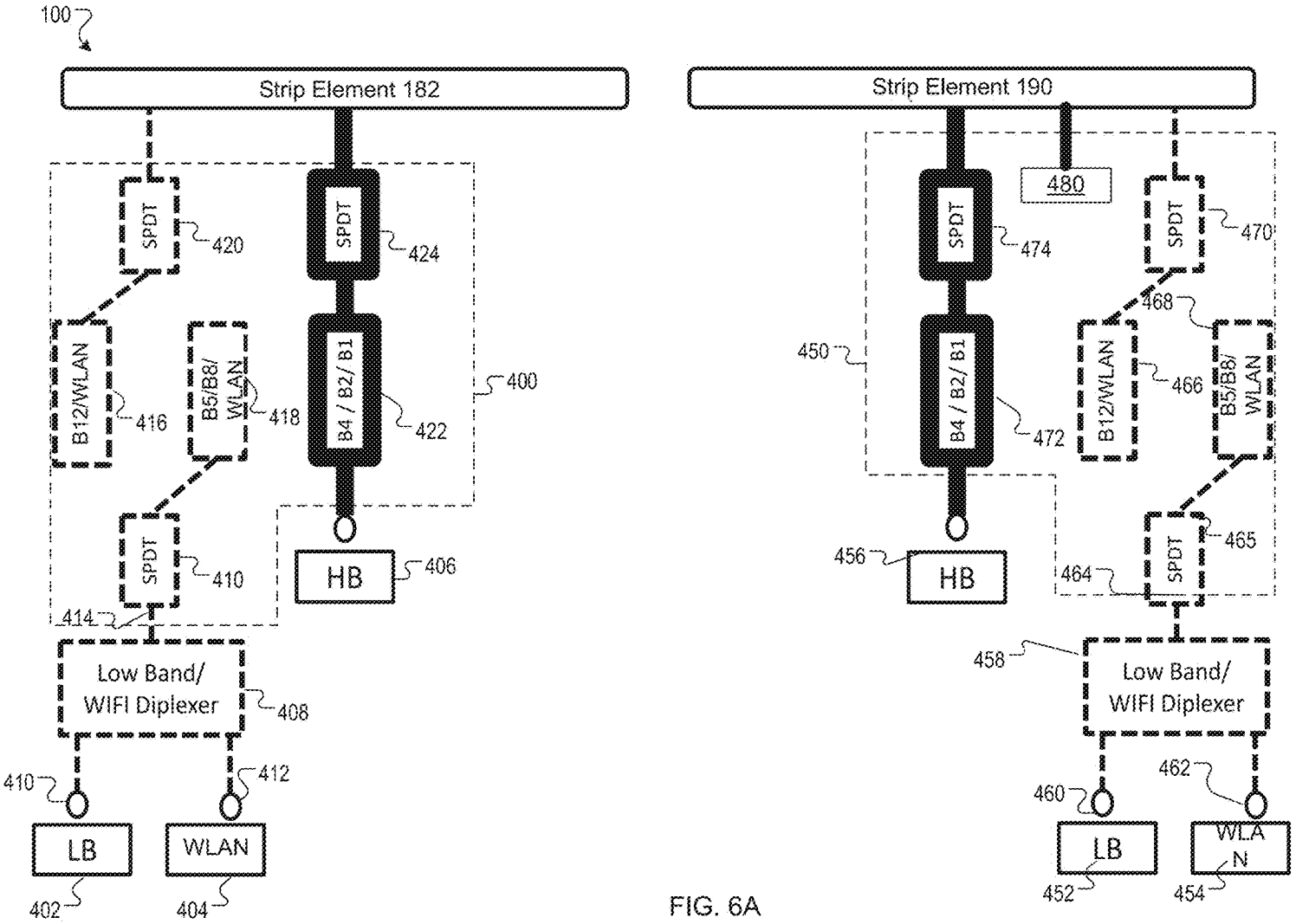
FIG. 6A illustrates a switching circuit of the electronic device operable to configure the antenna structure to communicate on a WAN frequency band according to one embodiment.

FIG. 6A illustrates a multi-connector switching circuitry 400 of the electronic device 100 (FIG. 1A or 1B) operable to configure the antenna structure 180 (FIG. 2) to communicate on a B4/B2/B1 LTE frequency band according to one embodiment. Some components of the multi-connector switching circuitry 400 of FIG. 6A are similar to some components of the multi-connector switching circuitry 400 of FIG. 6A as noted by similar reference numbers, unless expressly described otherwise. In one embodiment, the antenna structure 180 is configured to communicate on the B4/B2/B1 LTE frequency band, the SPDT switch 424 is connected to the B4/B2/B1 impedance matching circuit 422 (e.g., on mode) to connect the third feed point 406 to the first strip element 282. In one embodiment, when the antenna structure 180 is configured to communicate on the B4/B2/B1 LTE frequency band, the SPDT switch 415 is connected to the B5/B8/WLAN impedance matching circuit 418 and the SPDT switch 420 is connected to the B12/WLAN impedance matching circuit 416 so that the first feed point 402 and the second feed point 404 are not connected to the first strip element 282, e.g., a third state of the multi-connector switching circuitry 400. In another embodiment, when the antenna structure 180 is configured to communicate on the B4/B2/B1 LTE frequency band, the SPDT switch 420 is connected to the B5/B8/WLAN frequency-multiplexing circuit 418 and the SPDT switch 415 is connected to the B12/WLAN frequency-multiplexing circuit 416 so that the first feed point 402 and the second feed point 404 are not connected to the first strip element 282.

Figure 6B:
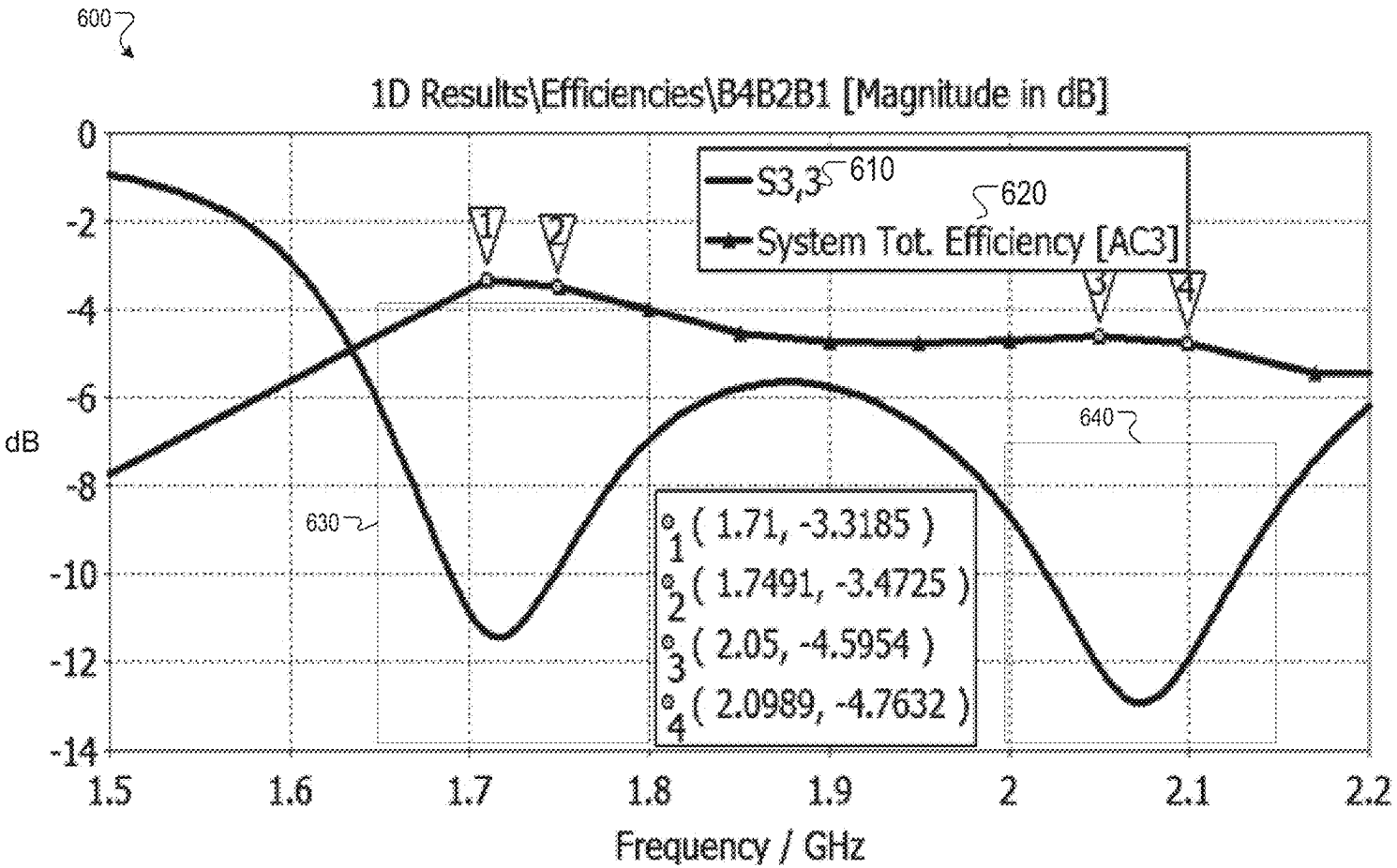
FIG. 6B shows another graph of the $S_{11}$ parameter and a total system efficiency of an antenna structure according to one embodiment.

FIG. 6B shows a graph 600 of the S11 parameter 610 and a total system efficiency parameter 620 of the antenna structure 180 of FIG. 2 according to one embodiment. The graph 600 shows the S11 parameter 610 of the antenna structure 180 in a first high band (HB) 630 and a second HB 640. The S11 parameter 610 is measured in dB. In one embodiment, the first HB 630 covers a frequency range between approximately 1.65 GHz and approximately 1.8 GHz, such as for the B4/B2/B1 LTE frequency band. In one embodiment, the second HB 640 covers a frequency range between approximately 2.0 GHz and approximately 2.15 GHz, such as for the B4/B2/B1 LTE frequency band. Alternatively, other frequencies in the first HB 630 and the second HB 640 may be covered by the antenna structure 180 configured for the high frequency bands. The graph 600 shows the total system efficiency parameter 620 of the antenna structure 180 in the first HB 630 and the second HB 640. The total system efficiency parameter 620 is measured in dB. The graph 600 further shows a reflection coefficient of the antenna structure 180 when using a component matching network. The frequency range of the antenna structure 180 is not intended to be limiting. The antenna structure 180 can communicate using other frequency bands.

Figure 7:
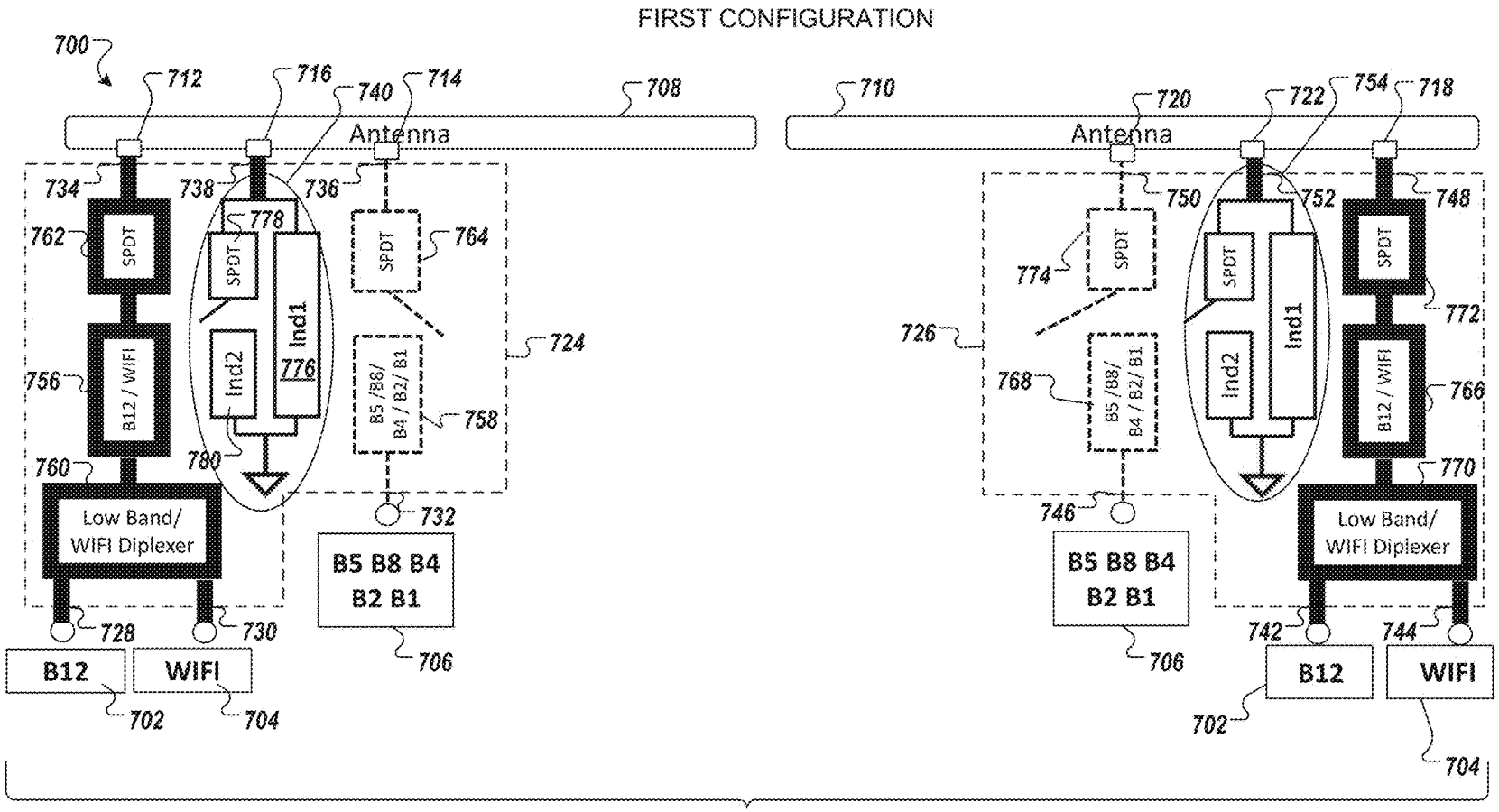
FIG. 7 illustrates a switching circuit of the electronic device operable to configure the antenna structure to communicate on the wireless local area network (WLAN) frequency band or a wide area network (WAN) frequency band according to another embodiment.

FIG. 7 illustrates a switching circuit of an electronic device 700 operable to configure an antenna structure to communicate on a wireless local area network (WLAN) frequency band or a wide area network (WAN) frequency band according to another embodiment. The electronic device 700 includes RF circuitry 710 that includes a first RF feed 702, a second RF feed 704, and a third RF feed 706. As describe herein, the electronic device includes a metal cover disposed on a non-display side of the electronic device 700. The metal cover includes a first strip element 708 disposed at a periphery of the metal cover on a first axis, a second strip element 710 disposed at the periphery of the metal cover on the first axis and adjacent to the first strip element 708, a first cutout (not illustrated in FIG. 7) in the metal cover that physically separates the first strip element 708 from other portions of the metal cover, and a second cutout (not illustrated in FIG. 7) in the metal cover that physically separates the second strip element from other portions of the metal cover. The antenna structure includes the first strip element 708 and the second strip element 710. The first strip element 708 includes multiple connectors, including a first connector 712 coupled to the first strip element 708 at a first location, a second connector 714 coupled to the first strip element 708 at a second location, and a third connector 716 coupled to the first strip element 708 at a third location. The second strip element 710 includes multiple connectors, including a fourth connector 718 coupled to the second strip element 710 at a fourth location, a fifth connector 720 coupled to the second strip element 710 at a fifth location, and a sixth connector 722 coupled to the second strip element 710 at a sixth location.

The electronic device 700 includes first multi-connector switching circuitry 724 coupled between the RF feeds 702-706 and the multiple connectors of the first strip element 708. The first multi-connector switching circuitry 724 includes a first input node 728 coupled to the first RF feed 702, a second input node 730 coupled to the second RF feed 704, a third input node 732 coupled to the third RF feed 706, a first output node 734 coupled to the first connector 712, a second output node 736 coupled to the second connector 714, a third output node 738 coupled to the third connector 716. The first multi-connector switching circuitry 724 includes a first configurable pre-matching circuit 740 coupled between ground and the third output node 738. The first configurable pre-matching circuit 740 can be used to change an impedance of the first strip element 708 between a first impedance value in a first configuration and a second impedance value in a second configuration.

The electronic device 700 includes second multi-connector switching circuitry 726 coupled between the RF feeds 702-706 and the multiple connectors of the second strip element 710. The second multi-connector switching circuitry 726 includes a first input node 742 coupled to the first RF feed 702, a second input node 744 coupled to the second RF feed 704, a third input node 746 coupled to the third RF feed 706, a first output node 748 coupled to the fourth connector 718, a second output node 750 coupled to the fifth connector 720, a third output node 752 coupled to the sixth connector 722. The second multi-connector switching circuitry 726 includes a second configurable pre-matching circuit 754 coupled between ground and the third output node 752. The second configurable pre-matching circuit 754 can be used to change an impedance of the second strip element 710 between the first impedance value in the first configuration and the second impedance value in the second configuration.

In a further embodiment, the first multi-connector switching circuitry 724 includes a first impedance matching circuit 756, a second impedance matching circuit 758 coupled to the third RF feed 732, a first diplexer 760 coupled to the first RF feed 702 and the second RF feed 704, as well as the first impedance matching circuit 756. The first multi-connector switching circuitry 724 includes a first switch 762 coupled between the first impedance matching circuit 756 and the first connector 712 and a second switch 764 coupled between the second impedance matching circuit 758 and the second connector 714.

In a further embodiment, the second multi-connector switching circuitry 726 includes a third impedance matching circuit 766, a fourth impedance matching circuit 768 coupled to the third RF feed 706, a second diplexer 770 coupled to the first RF feed 702 and the second RF feed 704, as well as the second impedance matching circuit 768. The second multi-connector switching circuitry 726 includes a third switch 772 coupled between the third impedance matching circuit 766 and the fourth connector 718 and a fourth switch 774 coupled between the fourth impedance matching circuit 768 and the fifth connector 720.

In one embodiment, the first multi-connector switching circuitry 724 can be configured in different configurations during different modes of operation of the first strip element 708. Similarly, the second multi-connector switching circuitry 726 can be configured in different configurations during different modes of operation of the second strip element 710. The first strip element 708 can operate in the same mode and the same configuration as the second strip element 710. Alternatively, the first strip element 708 can operate in a different mode, or a different configuration, or both as the second strip element 710. In one embodiment, the first multi-connector switching circuitry 724 is operable to connect the first RF feed 702, the second RF feed 704, or both to the first connector 712 in a first mode, and to connect the third RF feed 706 to the second connector 714 in a second mode. The second multi-connector switching circuitry 726 is operable to connect the first RF feed 702, the second RF feed 704, or both to the fourth connector 718 in the first mode, and to connect the third RF feed 706 to the fifth connector 720 in the second mode. In another embodiment, the first multi-connector switching circuitry 724 is operable to connect the first RF feed 702 to the first connector 712 in a first mode, to connect the third RF feed 706 to the second connector 714 in a second mode, and to connect the second RF feed 704 to the first connector 712 in a third mode. The second multi-connector switching circuitry 726 is operable to connect the first RF feed 702 to the fourth connector 718 in the first mode, to connect the third RF feed 706 to the fifth connector 720 in the second mode, and to connect the second RF feed 704 to the fourth connector 718 in a third mode. Alternative configurations are also possible.

In another embodiment, as illustrated in FIG. 7, the first pre-matching circuit 740 includes a first path having a first inductor 776 disposed between the third connector 716 and ground. The first inductor 776 has a first inductance value that results in a first impedance value for the first strip element 708. The first pre-matching circuit 740 also includes a second path disposed between the third connector 716 and ground in parallel with the first path. The second path has a switch 778 and a second inductor 780 with a second inductance value. The switch 778, when activated, switches the second inductor 789 in parallel with the first inductor 776 that results in a second impedance value for the first strip element 708. The second pre-matching circuit 754 may include similar paths with corresponding inductors and switch. In other embodiments, more switches and more paths may be used to achieve different impedance values for the respective strip element. It should be noted that discrete components may be used for the inductors. Alternatively, other elements having an inductance may be used, such as a microstrip or a trace, having those electrical properties, can be used for any one or more of the inductors.

It should be noted that the first multi-connector switching circuitry 724 and the second multi-connector switching circuitry 726 are illustrated in a first configuration in FIG. 7. That is, the switches 762 and 772 are closed, connecting the first RF feed 702, the second RF feed 704, or both to the first connector 712 and the fourth connector 718, respectively via the first impedance matching circuit 756 and the third impedance matching circuit 766, respectively. In this first configuration, the switches 764 and 774 are open, disconnecting the third RF feed 706 from the second connector 714 and the fifth connector 720.

It should also be noted that the switches are illustrated as SPDT switches. However, in other embodiments, different switch configurations are possible to connect the respective impedance matching circuits to connect to corresponding connectors of the strip elements.

Figure 8:
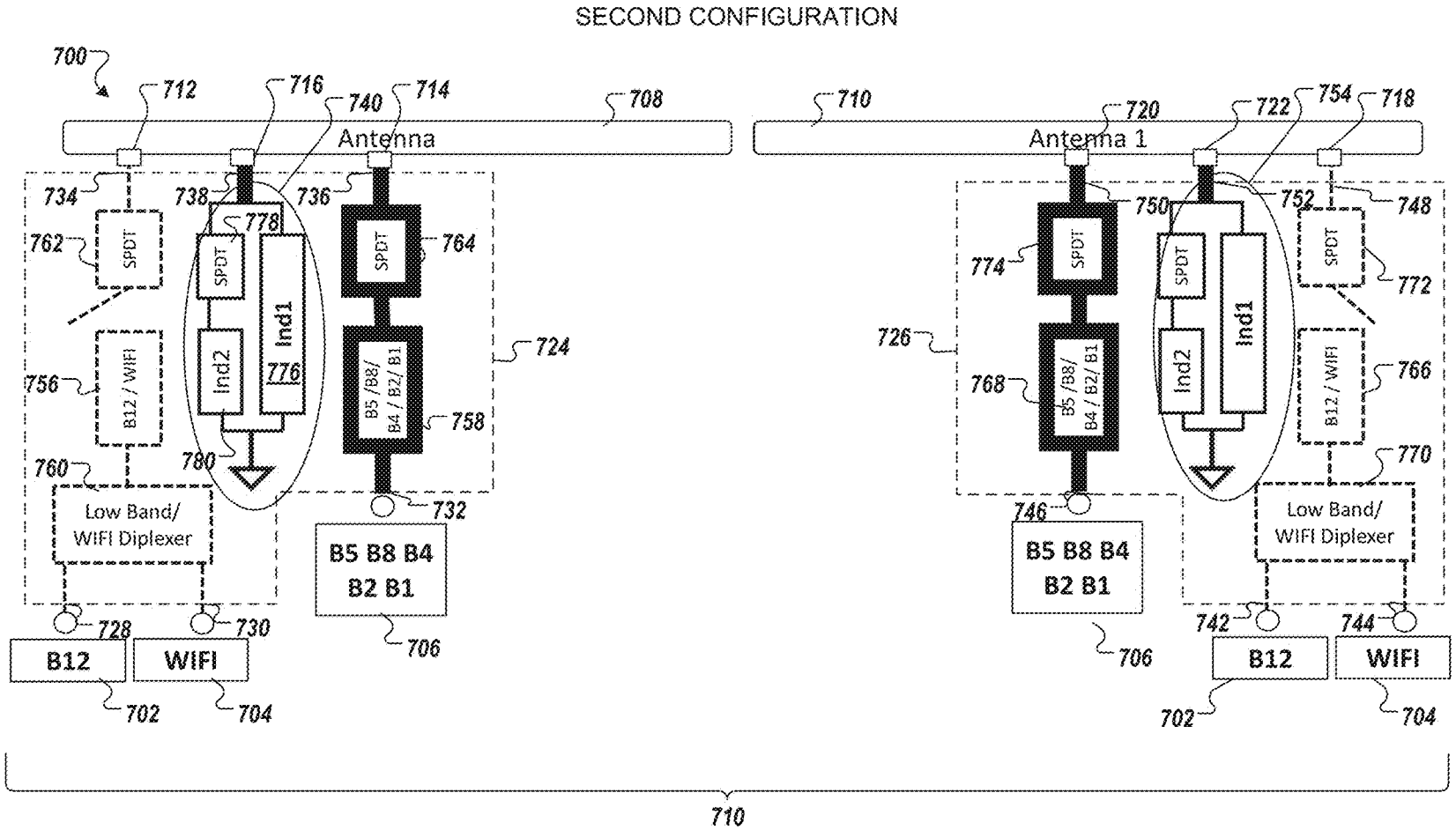
FIG. 8 illustrates a switching circuit of the electronic device operable to configure the antenna structure to communicate on the WLAN frequency band or a WAN frequency band according to another embodiment.

FIG. 8 illustrates the switching circuit of the electronic device 700 in a second configuration according to another embodiment. That is, the switches 764 and 774 are closed, connecting the third RF feed 706 from the second connector 714 and the fifth connector 720, respectively via the second impedance matching circuit 758 and the fourth impedance matching circuit 768, respectively. In this second configuration, the switches 762 and 772 are open, disconnecting the first RF feed 702 and the second RF feed 704 from the first connector 712 and the fourth connector 718.

In the embodiments illustrated in FIGS. 7-8, the connectors 712, 714, and 716 may be the same or similar to the connectors 284, 288, and 286, respectively, described above with respect to FIG. 2. Similarly, the connectors 718, 720, and 722 may be the same or similar to the connectors 292, 296, and 294 respectively, described above with respect to FIG. 2.

In one embodiment, the RF circuitry (one or multiple RF modules or radios) can radiate electromagnetic energy on the first strip element 708 and second strip element 710 by driving corresponding signals on the first RF feed 702, second RF feed 704, and/or third RF feed 706. In one embodiment, the RF circuitry can transmit or receive signals on the first RF feed 702 corresponding to B12 band, transmit or receive signals on the second RF feed 704 corresponding to a WLAN band (e.g., a band using the Wi-Fi® technology), and can transmit or receive signals on the third RF feed 706 corresponding to B5 band, B8, band, B4 band, B2, band, and B1 band. The first impedance matching circuit 756 and third impedance matching circuit 766 can be designed to permit the first strip element 708 and the second strip element 710 to operate in the B12 and WLAN bands. The second impedance matching circuit 758 and fourth impedance matching circuit 768 can be designed to permit the first strip element 708 and the second strip element 710 to operate in the B5, B8, B4, B2, and B1 bands. Alternatively, the impedance matching circuits can be designed to permit the first strip element 708 and the second strip element 710 to operate in other frequencies bands than those noted above.

The following graphs illustrate comparisons of efficiencies in some of these frequencies bands using 1) fixed pre-matching circuits as described above with respect to FIGS. 4A-6B and 2) configurable pre-matching circuit 740 as described above with respect to FIGS. 7-8.

Figure 9:
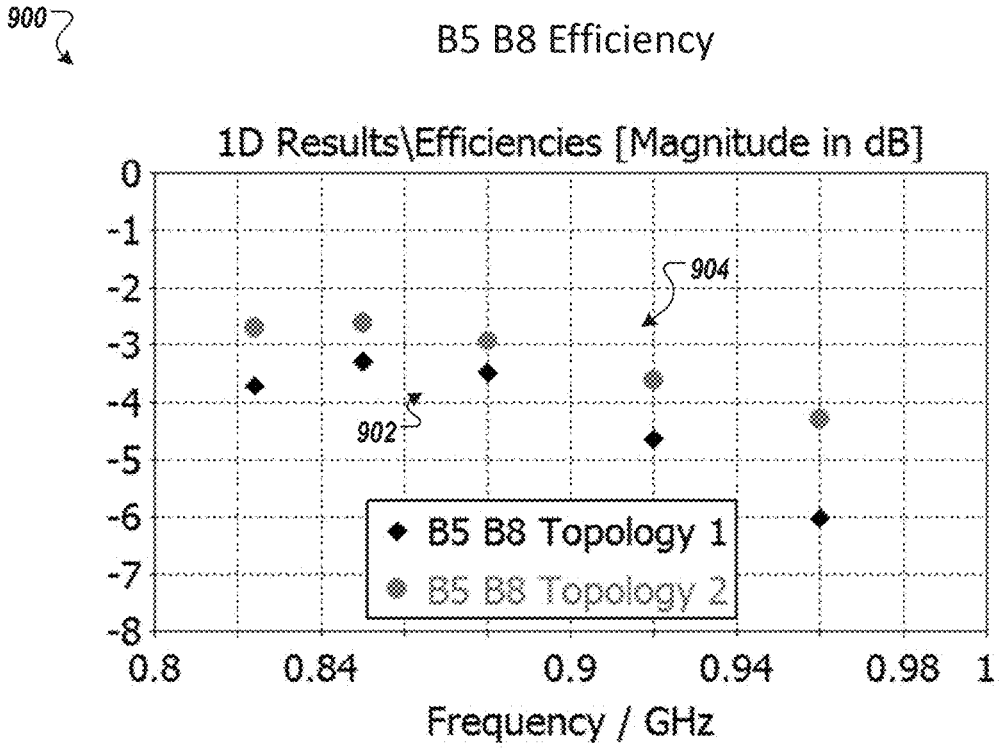
FIG. 9 shows a graph of efficiency comparisons of an antenna structure using a fixed pre-matching circuit and an antenna structure using a configurable pre-matching circuit in B5 and B8 bands according to one embodiment.

FIG. 9 shows a graph 900 of efficiency comparisons of an antenna structure using a fixed pre-matching circuit and an antenna structure using a configurable pre-matching circuit in B5 and B8 bands according to one embodiment. The graph 900 shows an antenna efficiency 902 in the B5 and B8 frequencies bands for a first topology that includes the antenna structure with the fixed pre-matching circuit as described herein. The graph 900 also shows an antenna efficiency 904 in the B5 and B8 frequencies bands for a second topology that includes the antenna structure with the configurable pre-matching circuit as described herein. The graph 900 illustrates that the both antenna structures are viable antennas for the respective frequency range and that there is an improvement in the efficiency using the second topology.

Figure 10:
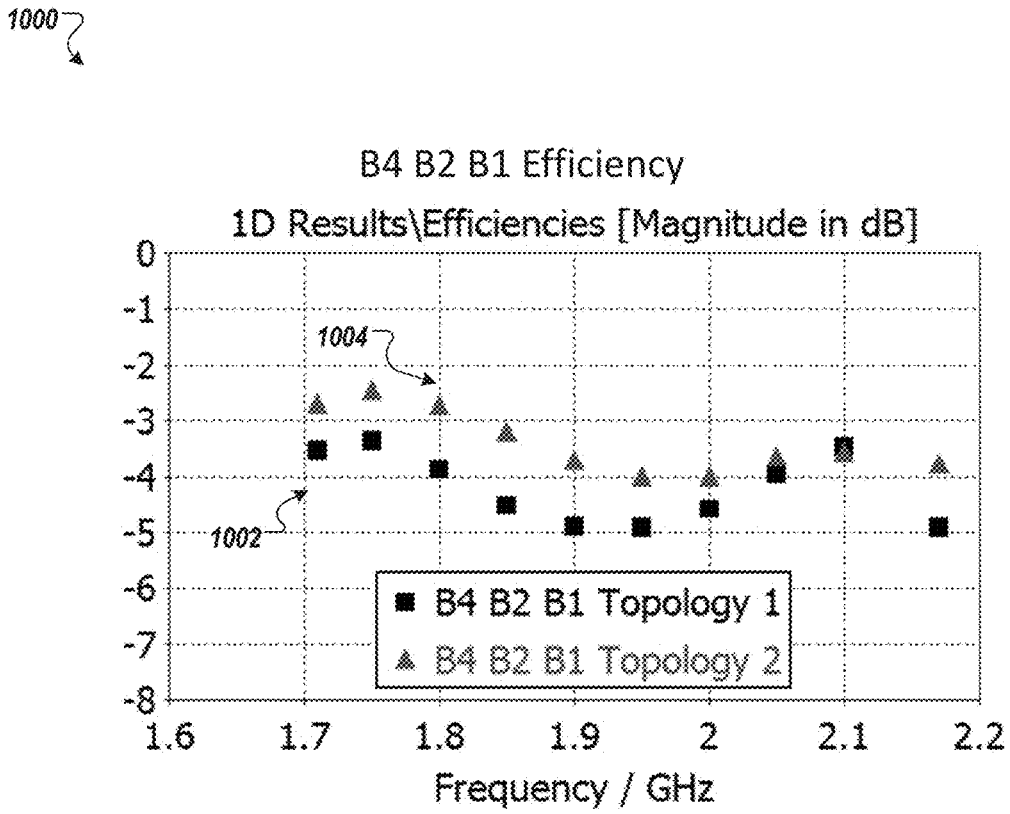
FIG. 10 shows a graph of efficiency comparisons of an antenna structure using a fixed pre-matching circuit and an antenna structure using a configurable pre-matching circuit in B4, B2, and B1 bands according to one embodiment.

FIG. 10 shows a graph of efficiency comparisons of an antenna structure using a fixed pre-matching circuit and an antenna structure using a configurable pre-matching circuit in B4, B2, and B1 bands according to one embodiment. The graph 1000 shows an antenna efficiency 1002 in the B4, B2, and B1 frequencies bands for a first topology that includes the antenna structure with the fixed pre-matching circuit as described herein. The graph 1000 also shows an antenna efficiency 1004 in the B4, B2, and B1 frequencies bands for a second topology that includes the antenna structure with the configurable pre-matching circuit as described herein. The graph 1000 illustrates that the both antenna structures are viable antennas for the respective frequency range and that there is an improvement in the efficiency using the second topology.

Figure 11:
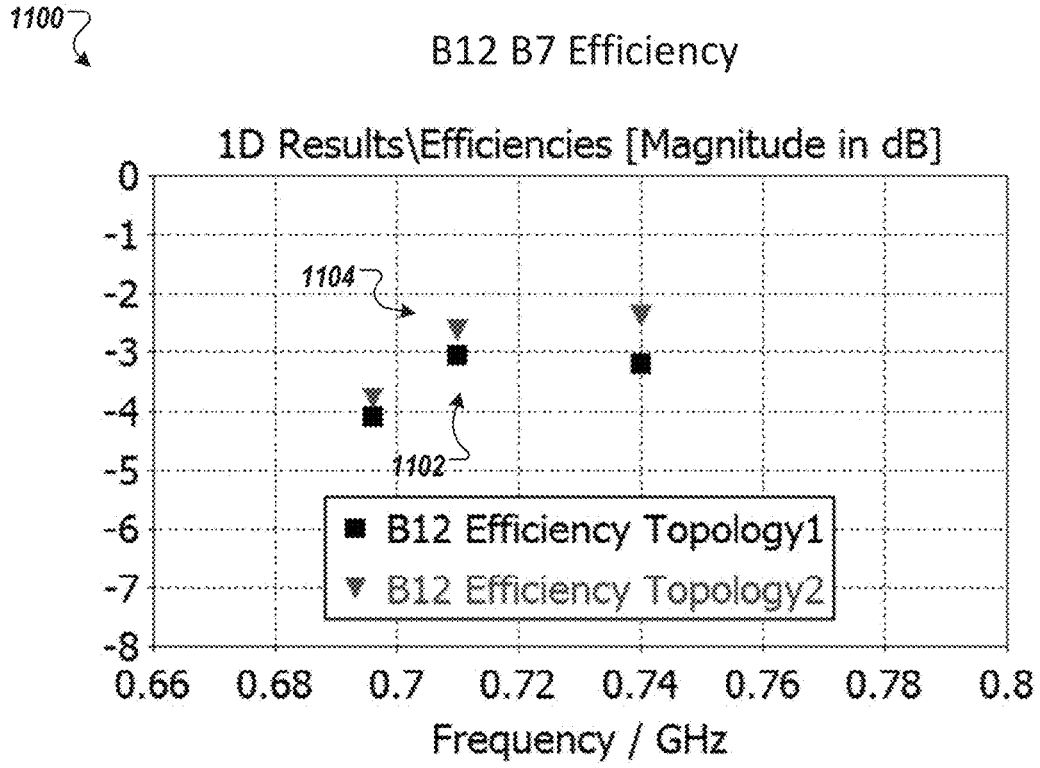
FIG. 11 shows a graph of efficiency comparisons of an antenna structure using a fixed pre-matching circuit and an antenna structure using a configurable pre-matching circuit in B12 and B7 bands according to one embodiment.

FIG. 11 shows a graph of efficiency comparisons of an antenna structure using a fixed pre-matching circuit and an antenna structure using a configurable pre-matching circuit in B12 and B7 bands according to one embodiment. The graph 1100 shows an antenna efficiency 1102 in the B12 and B7 frequencies bands for a first topology that includes the antenna structure with the fixed pre-matching circuit as described herein. The graph 1100 also shows an antenna efficiency 1104 in the B12 and B7 frequencies bands for a second topology that includes the antenna structure with the configurable pre-matching circuit as described herein. The graph 1100 illustrates that the both antenna structures are viable antennas for the respective frequency range and that there is an improvement in the efficiency using the second topology.

Figure 12:
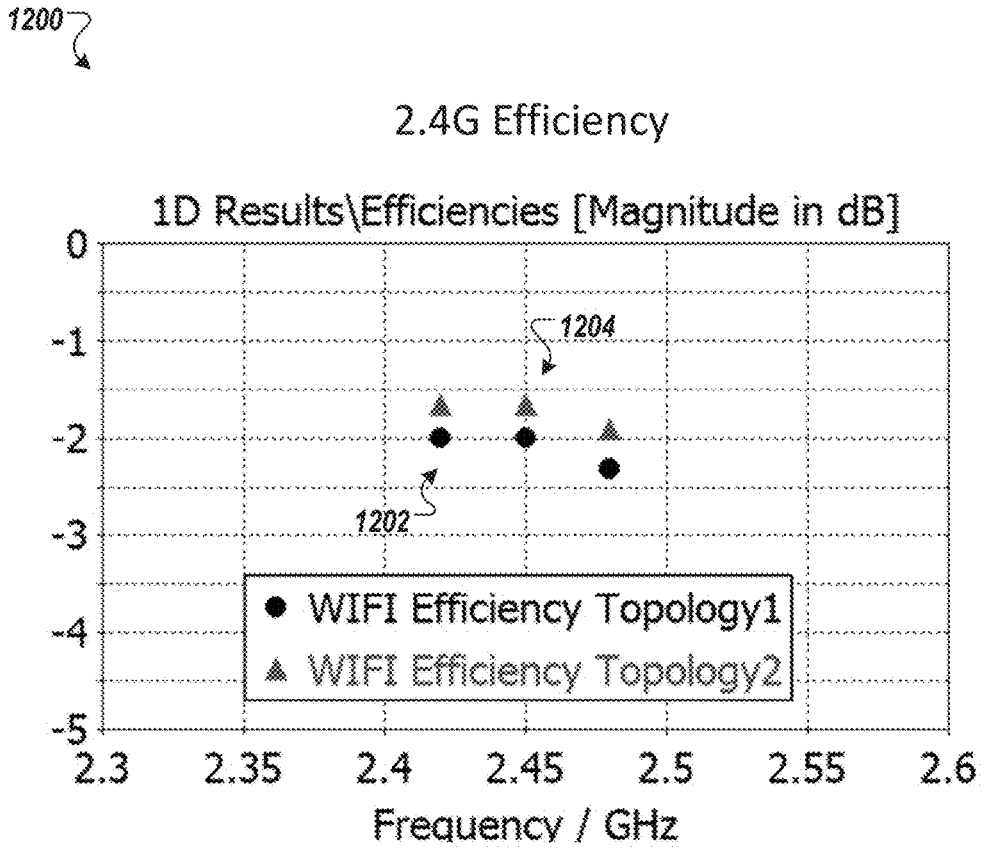
FIG. 12 shows a graph of efficiency comparisons of an antenna structure using a fixed pre-matching circuit and an antenna structure using a configurable pre-matching circuit in a WLAN band according to one embodiment.

FIG. 12 shows a graph of efficiency comparisons of an antenna structure using a fixed pre-matching circuit and an antenna structure using a configurable pre-matching circuit in a WLAN band according to one embodiment. The graph 1200 shows an antenna efficiency 1202 in the WLAN frequency band (e.g., 2.4 GHz) for a first topology that includes the antenna structure with the fixed pre-matching circuit as described herein. The graph 1200 also shows an antenna efficiency 1204 in the WLAN frequency band frequencies bands for a second topology that includes the antenna structure with the configurable pre-matching circuit as described herein. The graph 1200 illustrates that the both antenna structures are viable antennas for the respective frequency range and that there is an improvement in the efficiency using the second topology.

In another embodiment, an apparatus includes RF circuitry disposed within a housing, such as the housing described herein. The RF circuitry can include a first RF feed and a second RF feed. The housing includes a first strip element disposed at a periphery of the housing. The first strip element is physically separated from other portions of the housing by a first cutout in the housing. An antenna structure may include the first strip element with a first connector coupled to the first strip element at a first location, a second connector coupled to the first strip element at a second location, and a third connector coupled to the first strip element at a third location. First multi-connector switching circuitry is coupled to the first RF feed, the second RF feed, the first connector, the second connector, and the third connector. The first multi-connector switching circuitry is operable to connect the first RF feed to the first connector in a first mode and to connect the second RF feed to the second connector in a second mode. The first multi-connector switching circuitry includes a first configurable pre-matching circuit to change an impedance of the first strip element between a first impedance value in the first mode and a second impedance value in the second mode.

In a further embodiment, the housing may include a second strip element disposed at a periphery of the housing. The second strip element is physically separated from other portions of the housing by a second cutout in the housing. The antenna structure in this embodiment includes the first strip element with the first, second and third connectors, and the second strip element with a fourth connector coupled to the second strip element at a fourth location, a fifth connector coupled to the second strip element at a fifth location, and a sixth connector coupled to the second strip element at a sixth location. Second multi-connector switching circuitry is coupled to the first RF feed, the second RF feed, the fourth connector, the fifth connector, and the sixth connector. The second multi-connector switching circuitry is operable to connect the first RF feed to the fourth connector in the first mode and to connect the second RF feed to the fifth connector in the second mode.

In a further embodiment, the RF circuitry further includes a third RF feed coupled to the first multi-connector switching circuitry and the second multi-connector switching circuitry. In a further embodiment, the first multi-connector switching circuitry includes: a first impedance matching circuit; a second impedance matching circuit coupled to the second RF feed; a first diplexer coupled to the first RF feed, the third RF feed, and the first impedance matching circuit; a first switch coupled between the first impedance matching circuit and the first connector; and a second switch coupled between the second impedance matching circuit and the second connector. The second multi-connector switching circuitry includes: a third impedance matching circuit; a fourth impedance matching circuit coupled to the second RF feed; a second diplexer coupled to the first RF feed, the third RF feed, and the second impedance matching circuit; a third switch coupled between the third impedance matching circuit and the fourth connector; and a fourth switch coupled between the fourth impedance matching circuit and the fifth connector.

During operation, the first multi-connector switching circuitry can connect the first RF feed, the third RF feed, or both to the first connector in the first mode, and can connect the second RF feed to the second connector in the second mode. The second multi-connector switching circuitry can connect the first RF feed, the third RF feed, or both to the fourth connector in the first mode, and can connect the second RF feed to the fifth connector in the second mode. In another embodiment, the first multi-connector switching circuitry can connect the first RF feed to first connector in the first mode, connect the second RF feed to the second connector in the second mode, and connect the third RF feed to the first connector in a third mode. The second multi-connector switching circuitry can connect the first RF feed, to fourth connector in the first mode, connect the second RF feed to the fifth connector in the second mode, and connect the third RF feed to the fourth connector in the third mode. The RF circuitry, during operation, causes the first strip element and the second strip element to radiate electromagnetic energy in a first frequency range in the first mode and causes the first strip element and the second strip element to radiate electromagnetic energy in a second frequency range in the second mode.

As described herein, the first strip element and the second strip element are disposed at symmetric locations on a first side of the apparatus relative to a center point on the first side. The apparatus may also include a display structure wherein the housing surrounds a perimeter of the display structure. The display structure may have a touch screen display, a first touch trace along a first side of the perimeter the touch screen display, a second touch trace along a second side of the perimeter the touch screen display, a third touch trace along a third side of the perimeter the touch screen display, or any combination thereof. In one embodiment, the antenna structure is adjacent a fourth side of the perimeter the touch screen display.

In another embodiment, the first RF feed is coupled to the first strip element by the first connector and the first multi-connector switching circuitry. The RF circuitry drives a signal on the first RF feed to cause the first strip element to radiate electromagnetic energy between approximately 695 megahertz (MHz) and approximately 750 MHz. The third RF feed is coupled to the first strip element by the first connector and the first multi-connector switching circuitry. The RF circuitry drives a signal on the third RF feed to cause the first strip element to radiate electromagnetic energy between approximately 2.4 GHz to approximately 2.5 GHz. In a further embodiment, the second RF feed is coupled to the first strip element by the second connector and the first multi-connector switching circuitry. The RF circuitry drives a signal on the second RF feed to cause the first strip element to radiate electromagnetic energy between approximately 800 megahertz (MHz) to approximately 2.2 GHz.

In another embodiment, the apparatus includes proximity sensing circuitry coupled to the first strip element, as described herein. The proximity sensing circuitry can measure a capacitance of the first strip element to detect a body part proximate to the first strip element. Similarly, the second strip element can also be used as part of the same element used by the proximity sensing circuitry, or as separate elements to individually detect a body part proximate to the respective strip element.

In another embodiment, the antenna structure includes a metal housing, a first feed point coupled to a multi-connector switching circuitry, a second feed point coupled to the multi-connector switching circuitry, and a third feed point coupled to the multi-connector switching circuitry. The multi-connector switching circuitry can connect the first feed point to a strip element to cause the strip element to radiate electromagnetic energy in a first frequency range in a first mode, connect the second feed point to the strip element to cause the strip element to radiate electromagnetic energy in a second frequency range in a second mode, and connect the third feed point to the strip element to cause the strip element to radiate electromagnetic energy in a third frequency range in a third mode. The multi-connector switching circuitry includes a configurable pre-matching circuit to change an impedance of the strip element between a first impedance value in the first mode and a second impedance value in the second mode. The configurable pre-matching circuit is coupled to the strip element and can switch in different inductors to create different inductance values for the different modes or configurations.

In a further embodiment, the multi-connector switching circuitry includes 1) a first diplexer coupled to the first feed point and the second feed point; 2) a first impedance matching circuit coupled to the first diplexer; 3) a second impedance matching circuit coupled to the third feed point; 4) a first switch coupled between the first impedance matching circuit and a first connector of the strip element; and 5) a second switch coupled between the second impedance matching circuit and a second connector of the strip element, and wherein the configurable pre-matching circuit is coupled to a third connector of the strip element.

In other embodiments, the antenna structure includes the strip element and a second strip element. In one of these embodiments, the multi-connector switching circuitry further includes: 6) a second diplexer coupled to the first feed point and the second feed point; 7) a third impedance matching circuit coupled to the second diplexer; 8) a fourth impedance matching circuit coupled to the third feed point; 9) a third switch coupled between the third impedance matching circuit and a fourth connector of the second strip element; and 10) a fourth switch coupled between the fourth impedance matching circuit and a fifth connector of the second strip element. The multi-connector switching circuitry may include a second configurable pre-matching circuit coupled to a sixth connector of the second strip element. The second configurable pre-matching circuit can change an impedance of the second strip element between the first impedance value in the first mode and the second impedance value in the second mode.

In one embodiment, the strip element (and the second strip element) is operable to radiate electromagnetic energy as follows: between approximately 695 megahertz (MHz) and approximately 750 MHz in the first mode; between approximately 2.4 GHz to approximately 2.5 GHz in the first mode; and between approximately 800 megahertz (MHz) to approximately 2.2 GHz in the second mode. Alternatively, the antenna structure, using the multi-connector switching circuitry, can operate in other frequency ranges as described herein.

Figure 13:
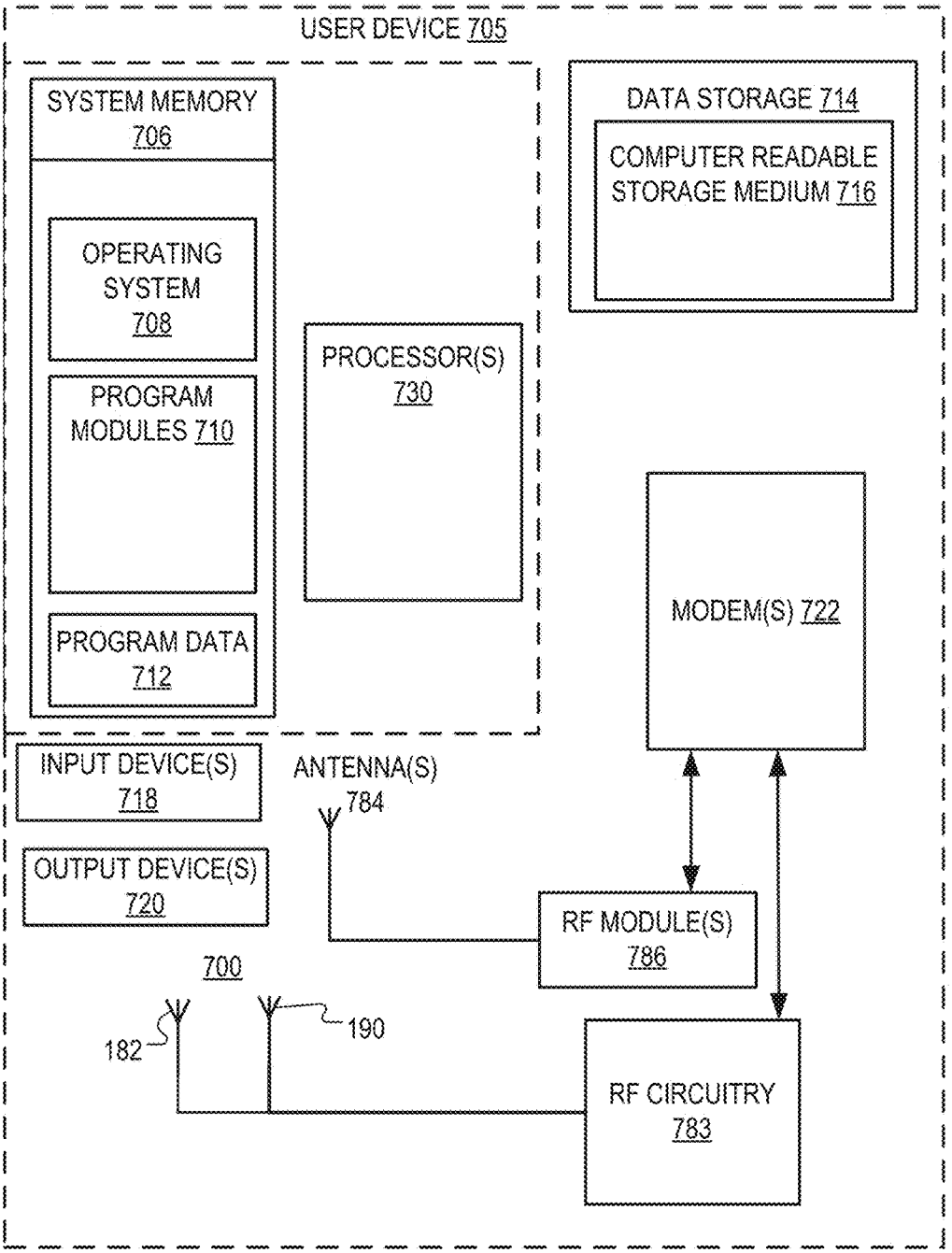
FIG. 13 is a block diagram of an electronic device in which embodiments of a radio device with an antenna structure may be implemented.

FIG. 13 is a block diagram of an electronic device 1305 in which embodiments of an antenna structure 180 (FIG. 2). The electronic device 1305 may correspond to the electronic device 100 of FIG. 1A or 1B. The electronic device 1305 may correspond to the electronic device 100 of FIG. 1A or 1B. The electronic device 1305 may be any type of computing device such as an electronic book reader, a PDA, a mobile phone, a laptop computer, a portable media player, a tablet computer, a camera, a video camera, a netbook, a desktop computer, a gaming console, a DVD player, a Blu-ray®, a computing pad, a media center, a voice-based personal data assistant, and the like. The electronic device 1305 may be any portable or stationary electronic device. For example, the electronic device 1305 may be an intelligent voice control and speaker system. Alternatively, the electronic device 1305 can be any other device used in a WLAN network (e.g., Wi-Fi® network), a WAN network, or the like.

The electronic device 1305 includes one or more processor(s) 1330, such as one or more CPUs, microcontrollers, field programmable gate arrays, or other types of processors. The electronic device 1305 also includes system memory 1306, which may correspond to any combination of volatile and/or non-volatile storage mechanisms. The system memory 1306 stores information that provides operating system component 1308, various program modules 1310, program data 1312, and/or other components. In one embodiment, the system memory 1306 stores instructions of the methods as described herein. The electronic device 1305 performs functions by using the processor(s) 1330 to execute instructions provided by the system memory 1306.

The electronic device 1305 also includes a data storage device 1314 that may be composed of one or more types of removable storage and/or one or more types of non-removable storage. The data storage device 1314 includes a computer-readable storage medium 1316 on which is stored one or more sets of instructions embodying any of the methodologies or functions described herein. Instructions for the program modules 1310 may reside, completely or at least partially, within the computer-readable storage medium 1316, system memory 1306 and/or within the processor(s) 1330 during execution thereof by the electronic device 1305, the system memory 1306 and the processor(s) 1330 also constituting computer-readable media. The electronic device 1305 may also include one or more input devices 1318 (keyboard, mouse device, specialized selection keys, etc.) and one or more output devices 1320 (displays, printers, audio output mechanisms, etc.).

The electronic device 1305 further includes a modem 1322 to allow the electronic device 1305 to communicate via a wireless network (e.g., such as provided by the wireless communication system) with other computing devices, such as remote computers, an item providing system, and so forth. The modem 1322 can be connected to RF circuitry 1383 and zero or more RF modules 1386. The RF circuitry 1383 may be a WLAN module, a WAN module, PAN module, or the like. Antennas 1388 are coupled to the RF circuitry 1383, which is coupled to the modem 1322. Zero or more antennas 1384 can be coupled to one or more RF modules 1386, which are also connected to the modem 1322. The zero or more antennas 1384 may be GPS antennas, NFC antennas, other WAN antennas, WLAN or PAN antennas, or the like. The modem 1322 allows the electronic device 1305 to handle both voice and non-voice communications (such as communications for text messages, multimedia messages, media downloads, web browsing, etc.) with a wireless communication system. The modem 1322 may provide network connectivity using any type of mobile network technology including, for example, cellular digital packet data (CDPD), general packet radio service (GPRS), EDGE, universal mobile telecommunications system (UMTS), 1 times radio transmission technology (1×RTT), evaluation data optimized (EVDO), high-speed down-link packet access (HSDPA), Wi-Fi®, Long Term Evolution (LTE) and LTE Advanced (sometimes generally referred to as 4G), etc.

The modem 1322 may generate signals and send these signals to antenna 1388 and 1384 via RF circuitry 1383 and RF module(s) 1386 as described herein. Electronic device 1305 may additionally include a WLAN module, a GPS receiver, a PAN transceiver and/or other RF modules. These RF modules may additionally or alternatively be connected to one or more of antennas 1384, 1388. Antennas 1384, 1388 may be configured to transmit in different frequency bands and/or using different wireless communication protocols. The antennas 1384, 1388 may be directional, omnidirectional, or non-directional antennas. In addition to sending data, antennas 1384, 1388 may also receive data, which is sent to appropriate RF modules connected to the antennas.

In one embodiment, the electronic device 1305 establishes a first connection using a first wireless communication protocol, and a second connection using a different wireless communication protocol. The first wireless connection and second wireless connection may be active concurrently, for example, if an electronic device is downloading a media item from a server (e.g., via the first connection) and transferring a file to another electronic device (e.g., via the second connection) at the same time. Alternatively, the two connections may be active concurrently during a handoff between wireless connections to maintain an active session (e.g., for a telephone conversation). Such a handoff may be performed, for example, between a connection to a WLAN hotspot and a connection to a wireless carrier system. In one embodiment, the first wireless connection is associated with a first resonant mode of an antenna structure that operates at a first frequency band and the second wireless connection is associated with a second resonant mode of the antenna structure that operates at a second frequency band. In another embodiment, the first wireless connection is associated with a first antenna element and the second wireless connection is associated with a second antenna element. In other embodiments, the first wireless connection may be associated with a media purchase application (e.g., for downloading electronic books), while the second wireless connection may be associated with a wireless ad hoc network application. Other applications that may be associated with one of the wireless connections include, for example, a game, a telephony application, an Internet browsing application, a file transfer application, a global positioning system (GPS) application, and so forth.

Though a modem 1322 is shown to control transmission and reception via antenna (1384, 1388), the electronic device 1305 may alternatively include multiple modems, each of which is configured to transmit/receive data via a different antenna and/or wireless transmission protocol.

The electronic device 1305 delivers and/or receives items, upgrades, and/or other information via the network. For example, the electronic device 1305 may download or receive items from an item providing system. The item providing system receives various requests, instructions and other data from the electronic device 1305 via the network. The item providing system may include one or more machines (e.g., one or more server computer systems, routers, gateways, etc.) that have processing and storage capabilities to provide the above functionality. Communication between the item providing system and the electronic device 1305 may be enabled via any communication infrastructure. One example of such an infrastructure includes a combination of a WAN and wireless infrastructure, which allows a user to use the electronic device 1305 to purchase items and consume items without being tethered to the item providing system via hardwired links. The wireless infrastructure may be provided by one or multiple wireless communications systems, such as one or more wireless communications systems. One of the wireless communication systems may be a WLAN hotspot connected with the network. The WLAN hotspots can be created by products using the Wi-Fi® technology based on IEEE 802.11x standards by Wi-Fi Alliance. Another of the wireless communication systems may be a wireless carrier system that can be implemented using various data processing equipment, communication towers, etc. Alternatively, or in addition, the wireless carrier system may rely on satellite technology to exchange information with the electronic device 1305.

The communication infrastructure may also include a communication-enabling system that serves as an intermediary in passing information between the item providing system and the wireless communication system. The communication-enabling system may communicate with the wireless communication system (e.g., a wireless carrier) via a dedicated channel, and may communicate with the item providing system via a non-dedicated communication mechanism, e.g., a public WAN such as the Internet.

The electronic devices 1305 are variously configured with different functionality to enable consumption of one or more types of media items. The media items may be any type of format of digital content, including, for example, electronic texts (e.g., eBooks, electronic magazines, digital newspapers, etc.), digital audio (e.g., music, audible books, etc.), digital video (e.g., movies, television, short clips, etc.), images (e.g., art, photographs, etc.), and multi-media content. The electronic devices 1305 may include any type of content rendering devices such as electronic book readers, portable digital assistants, mobile phones, laptop computers, portable media players, tablet computers, cameras, video cameras, netbooks, notebooks, desktop computers, gaming consoles, DVD players, media centers, and the like.

In the above description, numerous details are set forth. It will be apparent, however, to one of ordinary skill in the art having the benefit of this disclosure, that embodiments may be practiced without these specific details. In some instances, well-known structures and devices are shown in block diagram form, rather than in detail, in order to avoid obscuring the description.

Some portions of the detailed description are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers or the like.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as "inducing," "ally inducing," "radiating," "detecting," determining," "generating," "communicating," "receiving," "disabling," or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

Embodiments also relate to an apparatus for performing the operations herein. This apparatus may be specially constructed for the required purposes, or it may comprise a general-purpose computer selectively activated or reconfigured by a computer program stored in the computer. Such a computer program may be stored in a computer readable storage medium, such as, but not limited to, any type of disk including floppy disks, optical disks, CD-ROMs and magnetic-optical disks, read-only memories (ROMs), random access memories (RAMs), EPROMs, EEPROMs, magnetic or optical cards, or any type of media suitable for storing electronic instructions.

The algorithms and displays presented herein are not inherently related to any particular computer or other apparatus. Various general-purpose systems may be used with programs in accordance with the teachings herein, or it may prove convenient to construct a more specialized apparatus to perform the required method steps. The required structure for a variety of these systems will appear from the description below. In addition, the present embodiments are not described with reference to any particular programming language. It will be appreciated that a variety of programming languages may be used to implement the teachings of the present invention as described herein. It should also be noted that the terms "when" or the phrase "in response to," as used herein, should be understood to indicate that there may be intervening time, intervening events, or both before the identified operation is performed.

It is to be understood that the above description is intended to be illustrative, and not restrictive. Many other embodiments will be apparent to those of skill in the art upon reading and understanding the above description. The scope of the present embodiments should, therefore, be determined with reference to the appended claims, along with the full scope of equivalents to which such claims are entitled.

What is claimed is:

1. An electronic device comprising:

radio frequency (RF) circuitry comprising a first RF feed, a second RF feed, and a third RF feed;

a metal cover disposed on a non-display side of the electronic device, the metal cover comprising:

a first strip element disposed at a periphery of the metal cover on a first axis;

a second strip element disposed at the periphery of the metal cover on the first axis and adjacent to the first strip element;

a first cutout in the metal cover that physically separates the first strip element from other portions of the metal cover; and a second cutout in the metal cover that physically separates the second strip element from other portions of the metal cover;

an antenna structure comprising:

the first strip element;

the second strip element;

a first connector coupled to the first strip element at a first feed point at a first location on the first strip element;

a second connector coupled to the first strip element at a second feed point at a second location on the first strip element;

a third connector coupled to the first strip element at a third feed point at a third location on the first strip element;

a fourth connector coupled to the second strip element at a fourth feed point at a fourth location on the second strip element;

a fifth connector coupled to the second strip element at a fifth feed point at a fifth location on the second strip element; and a sixth connector coupled to the second strip element at a sixth feed point at a sixth location on the second strip element;

first multi-connector switching circuitry comprising:

a first input node coupled to the first RF feed;

a second input node coupled to the second RF feed;

a third input node coupled to the third RF feed;

a first output node coupled to the first connector;

a second output node coupled to the second connector;

a third output node coupled to the third connector; and a first configurable pre-matching circuit coupled between ground and the third output node, the first configurable pre-matching circuit to change an impedance of the first strip element between a first impedance value in a first configuration and a second impedance value in a second configuration; and second multi-connector switching circuitry comprising:

a first input node coupled to the first RF feed;

a second input node coupled to the second RF feed;
a third input node coupled to the third RF feed;
a first output node coupled to the fourth connector;
a second output node coupled to the fifth connector;
a third output node coupled to the sixth connector; and
a second configurable pre-matching circuit coupled between ground and the third output node of the second multi-connector switching circuitry, the second configurable pre-matching circuit to change an impedance of the second strip element between the first impedance value in the first configuration and the second impedance value in the second configuration.

2. The electronic device of claim 1, wherein:
the first multi-connector switching circuitry further comprises:
a first impedance matching circuit;
a second impedance matching circuit coupled to the third RF feed;
a first diplexer coupled to the first RF feed, the second RF feed, and the first impedance matching circuit;
a first switch coupled between the first impedance matching circuit and the first connector; and
a second switch coupled between the second impedance matching circuit and the second connector; and
the second multi-connector switching circuitry further comprises:
a third impedance matching circuit;
a fourth impedance matching circuit coupled to the third RF feed;
a second diplexer coupled to the first RF feed, the second RF feed, and the second impedance matching circuit;
a third switch coupled between the third impedance matching circuit and the fourth connector; and
a fourth switch coupled between the fourth impedance matching circuit and the fifth connector.

3. The electronic device of claim 1, wherein:
the first multi-connector switching circuitry is operable to connect the first RF feed, the second RF feed, or both to the first connector in a first mode, and to connect the third RF feed to the second connector in a second mode; and
the second multi-connector switching circuitry is operable to connect the first RF feed, the second RF feed, or both to the fourth connector in the first mode, and to connect the third RF feed to the fifth connector in the second mode.

4. The electronic device of claim 3, wherein the first pre-matching circuit comprises:
a first path having a first inductor disposed between the third connector and ground, the first inductor with a first inductance value that results in the first impedance value for the first strip element;
a second path disposed between the third connector and ground in parallel with the first path, the second path having a switch and a second inductor with a second inductance value, wherein the switch, when activated, switches the second inductor in parallel with the first inductor that results in the second impedance value for the first strip element.

5. An apparatus comprising:
radio frequency (RF) circuitry comprising a first RF feed and a second RF feed;
a housing comprising a first strip element disposed at a periphery of the housing, wherein the first strip element is physically separated from other portions of the housing by a first cutout in the housing;
an antenna structure comprising:
the first strip element;
a first connector coupled to the first strip element at a first feed point at a first location on the first strip element;
a second connector coupled to the first strip element at a second feed point at a second location on the first strip element; and
a third connector coupled to the first strip element at a third feed point at a third location on the first strip element; and
first multi-connector switching circuitry coupled to the first RF feed, the second RF feed, the first connector, the second connector, and the third connector, wherein the first multi-connector switching circuitry is operable to connect the first RF feed to the first connector in a first mode and to connect the second RF feed to the second connector in a second mode, and wherein the first multi-connector switching circuitry comprises a first configurable pre-matching circuit to change an impedance of the first strip element between a first impedance value in the first mode and a second impedance value in the second mode.

6. The apparatus of claim 5, wherein:
the housing comprises a second strip element disposed at a periphery of the housing;
the second strip element is physically separated from other portions of the housing by a second cutout in the housing; and
the antenna structure further comprises:
the second strip element;
a fourth connector coupled to the second strip element at a fourth feed point at a fourth location on the second strip element;
a fifth connector coupled to the second strip element at a fifth feed point at a fifth location on the second strip element; and
a sixth connector coupled to the second strip element at a sixth feed point at a sixth location on the second strip element; and
second multi-connector switching circuitry coupled to the first RF feed, the second RF feed, the fourth connector, the fifth connector, and the sixth connector, and
the second multi-connector switching circuitry is operable to connect the first RF feed to the fourth connector in the first mode and to connect the second RF feed to the fifth connector in the second mode, and wherein the second multi-connector switching circuitry comprises a second configurable pre-matching circuit to change an impedance of the second strip element between the first impedance value in the first mode and the second impedance value in the second mode.

7. The apparatus of claim 6, wherein the RF circuitry further comprises a third RF feed coupled to the first multi-connector switching circuitry and the second multi-connector switching circuitry.

8. The apparatus of claim 7, wherein:
the first multi-connector switching circuitry further comprises:
a first impedance matching circuit;
a second impedance matching circuit coupled to the second RF feed;
a first diplexer coupled to the first RF feed, the third RF feed, and the first impedance matching circuit;

a first switch coupled between the first impedance matching circuit and the first connector; and a second switch coupled between the second impedance matching circuit and the second connector; and the second multi-connector switching circuitry further comprises:

a third impedance matching circuit;

a fourth impedance matching circuit coupled to the second RF feed;

a second diplexer coupled to the first RF feed, the third RF feed, and the second impedance matching circuit;

a third switch coupled between the third impedance matching circuit and the fourth connector; and a fourth switch coupled between the fourth impedance matching circuit and the fifth connector.

9. The apparatus of claim 8, wherein:

the first multi-connector switching circuitry is operable to connect the first RF feed, the third RF feed, or both to the first connector in the first mode, and to connect the second RF feed to the second connector in the second mode; and the second multi-connector switching circuitry is operable to connect the first RF feed, the third RF feed, or both to the fourth connector in the first mode, and to connect the second RF feed to the fifth connector in the second mode.

10. The apparatus of claim 8, wherein:

the first multi-connector switching circuitry is operable to connect the first RF feed to first connector in the first mode, connect the second RF feed to the second connector in the second mode, and connect the third RF feed to the first connector in a third mode; and the second multi-connector switching circuitry is operable to connect the first RF feed, to fourth connector in the first mode, connect the second RF feed to the fifth connector in the second mode, and connect the third RF feed to the fourth connector in the third mode.

11. The apparatus of claim 6, wherein the RF circuitry is operable to:

cause the first strip element and the second strip element to radiate electromagnetic energy in a first frequency range in the first mode; and cause the first strip element and the second strip element to radiate electromagnetic energy in a second frequency range in the second mode.

12. The apparatus of claim 6, wherein the first strip element and the second strip element are disposed at symmetric locations on a first side of the apparatus relative to a center point on the first side.

13. The apparatus of claim 5, further comprising a display structure wherein the housing surrounds a perimeter of the display structure, the display structure comprising:

a touch screen display;

a first touch trace along a first side of the perimeter the touch screen display;

a second touch trace along a second side of the perimeter the touch screen display; and a third touch trace along a third side of the perimeter the touch screen display, wherein the antenna structure is adjacent a fourth side of the perimeter the touch screen display.

14. The apparatus of claim 5, wherein the first RF feed is coupled to the first strip element by the first connector and the first multi-connector switching circuitry, wherein the RF circuitry is operable to drive a signal on the first RF feed to cause the first strip element to radiate electromagnetic energy between approximately 695 megahertz (MHz) and approximately 750 MHz, wherein a third RF feed is coupled to the first strip element by the first connector and the first multi-connector switching circuitry, and wherein the RF circuitry is operable to drive a signal on the third RF feed to cause the first strip element to radiate electromagnetic energy between approximately 2.4 GHz to approximately 2.5 GHz.

15. The apparatus of claim 5, wherein the second RF feed is coupled to the first strip element by the second connector and the first multi-connector switching circuitry, wherein the RF circuitry is operable to drive a signal on the second RF feed to cause the first strip element to radiate electromagnetic energy between approximately 800 megahertz (MHz) to approximately 2.2 GHz.

16. The apparatus of claim 5, further comprising proximity sensing circuitry coupled to the first strip element, wherein the proximity sensing circuitry is operable to measure a capacitance of the first strip element to detect a body part proximate to the first strip element.

17. An antenna structure comprising:

a metal housing comprising a strip element isolated from other portions of the housing;

a first feed point coupled to a multi-connector switching circuitry and coupled to the strip element at a first location;

a second feed point coupled to the multi-connector switching circuitry and coupled to the strip element at a second location;

a third feed point coupled to the multi-connector switching circuitry and coupled to the strip element at a third location; and the multi-connector switching circuitry to connect the first feed point to the strip element to cause the strip element to radiate electromagnetic energy in a first frequency range in a first mode, to connect the second feed point to the strip element to cause the strip element to radiate electromagnetic energy in a second frequency range in a second mode, and to connect the third feed point to the strip element to cause the strip element to radiate electromagnetic energy in a third frequency range in a third mode, wherein the multi-connector switching circuitry comprises a configurable pre-matching circuit, coupled to the third feed point, the configurable pre-matching circuit configured to selectively change an impedance of the strip element between a first impedance value in the first mode and a second impedance value in the second mode.

18. The antenna structure of claim 17, wherein the multi-connector switching circuitry further comprises:

a first diplexer coupled to the first feed point and the second feed point;

a first impedance matching circuit coupled to the first diplexer;

a second impedance matching circuit coupled to the third feed point;

a first switch coupled between the first impedance matching circuit and a first connector of the strip element; and a second switch coupled between the second impedance matching circuit and a second connector of the strip element, and wherein the configurable pre-matching circuit is coupled to a third connector of the strip element.

19. The antenna structure of claim 18, further comprising a second strip element isolated from the other portions of the housing and the strip element, and wherein the multi-connector switching circuitry further comprises:

a second diplexer coupled to the first feed point and the second feed point;

a third impedance matching circuit coupled to the second diplexer;

a fourth impedance matching circuit coupled to the third feed point;

a third switch coupled between the third impedance matching circuit and a fourth connector of the second strip element; and a fourth switch coupled between the fourth impedance matching circuit and a fifth connector of the second strip element, wherein the multi-connector switching circuitry further comprises a second configurable pre-matching circuit coupled to a sixth connector of the second strip element, the second configurable pre-matching circuit to change an impedance of the second strip element between the first impedance value in the first mode and the second impedance value in the second mode.

20. The antenna structure of claim 17, wherein the strip element is operable to radiate electromagnetic energy as follows:

between approximately 695 megahertz (MHz) and approximately 750 MHz in the first mode;

between approximately 2.4 GHz to approximately 2.5 GHz in the first mode; and between approximately 800 megahertz (MHz) to approximately 2.2 GHz in the second mode.

* * * * *